US012622488B2

(12) United States Patent
Weeks et al.

(10) Patent No.: US 12,622,488 B2
(45) **Date of Patent: *May 12, 2026**

(54) FOOTWEAR HEEL COUNTER FOR EASIER FOOT ENTRY OR REMOVAL

(71) Applicant: Skechers U.S.A., Inc. II, Manhattan Beach, CA (US)

(72) Inventors: John Maxwell Weeks, Los Angeles, CA (US); Scott Kelley, Redondo Beach, CA (US); Frank F Chuang, Cypress, CA (US); Pei-Chun Liao, Torrance, CA (US); Johnson Tja, Foshan City (CN); Hui Xie, Dongguan City (CN); Kurt Stockbridge, Palos Verdes Estates, CA (US)

(73) Assignee: Skechers U.S.A., Inc. II, Manhattan Beach, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/733,795

(22) Filed: Jun. 4, 2024

(65) Prior Publication Data

US 2024/0324726 A1 Oct. 3, 2024

Related U.S. Application Data

(63) Continuation of application No. 18/199,262, filed on May 18, 2023, now Pat. No. 12,011,064, which is a (Continued)

(51) Int. Cl.

| | |
|---|---|
| ***A43B 23/08*** | (2006.01) |
| ***A43B 11/00*** | (2006.01) |
| ***A43B 21/24*** | (2006.01) |

(52) U.S. Cl.

CPC ..... *A43B 23/08* (2013.01); *A43B 11/00* (2013.01); *A43B 21/24* (2013.01); *A43B 23/088* (2013.01)

(58) Field of Classification Search

CPC ... A43B 21/26; A43B 23/088; A43B 23/0235; A43B 7/20; A43B 3/0057

See application file for complete search history.

(56) References Cited

U.S. PATENT DOCUMENTS

| | | | |
|---|---|---|---|
| 287,312 | A | 10/1883 | Packard |
| 863,549 | A | 8/1907 | Metz |

(Continued)

FOREIGN PATENT DOCUMENTS

| | | | |
|---|---|---|---|
| AU | 2017254675 | A1 | 11/2018 |
| CL | 202302398 | | 8/2023 |

(Continued)

OTHER PUBLICATIONS

International Search Report and Written Opinion mailed Mar. 1, 2023 for PCT Application No. PCT/US2022/46726.

(Continued)

*Primary Examiner* — Jillian K Pierorazio

(74) *Attorney, Agent, or Firm* — Marshall A. Lerner; Steven J. Kim; Daniel J. Malkin

(57) ABSTRACT

The article of footwear further includes a heel cup attached to the upper and extending from the sole structure to at least a portion of the rear heel collar of upper. Additionally, the heel cup is uniformly molded with an upper portion, midportion, and lower portion and the upper portion has a smaller mediolateral length than the midportion, and the midportion and lower portion form a concave structure configured to receive the heel. The midportion includes a peripheral portion having a first thickness and a central portion having a second thickness, and the second thickness is less than the first thickness.

19 Claims, 16 Drawing Sheets

Related U.S. Application Data continuation of application No. PCT/US2022/046726, filed on Oct. 14, 2022.

(60) Provisional application No. 63/256,521, filed on Oct. 15, 2021.

(56) References Cited

U.S. PATENT DOCUMENTS 1,174,619 A * 3/1916 Scholl ..... A43B 23/28 36/68
3,049,815 A 8/1962 Wilburn
3,693,270 A 9/1972 Murray
3,768,182 A * 10/1973 Powers ..... A43B 5/00 36/114
4,451,996 A * 6/1984 Norton ..... A43B 19/00 36/129
4,550,511 A 11/1985 Gamm
4,559,722 A * 12/1985 Norton ..... A43B 23/0235 36/105
4,594,798 A * 6/1986 Autry ..... A43B 23/17 36/114
4,608,769 A * 9/1986 Sturlaugson ..... A43B 11/00 36/51
4,622,764 A 11/1986 Boulier
4,642,916 A 2/1987 Collins
4,662,088 A * 5/1987 Autry ..... A43B 23/028 36/105
4,856,209 A * 8/1989 Kenyon ..... A43B 7/20 36/114
5,894,684 A 4/1999 Sand et al.
6,041,524 A 3/2000 Brooks
6,880,272 B2 4/2005 Wells
D628,782 S * 12/2010 Butler ..... D2/964
9,730,494 B1 8/2017 Feinstein
9,756,903 B1 9/2017 Koo
10,455,898 B1 10/2019 ORand
10,687,586 B2 6/2020 Sullivan
11,000,091 B1 5/2021 Kyle
11,633,006 B2 4/2023 Pratt et al.
11,871,811 B1 1/2024 Pratt et al.
12,029,276 B2 7/2024 Shin
2001/0032399 A1* 10/2001 Litchfield ..... A43B 1/0072 36/114
2002/0008124 A1 1/2002 Runge
2002/0066213 A1* 6/2002 Wells ..... A43B 3/0084 223/118
2002/0166257 A1* 11/2002 Wilkinson ..... A43B 7/12 36/3 A
2004/0049942 A1* 3/2004 Chen ..... A43B 7/085 36/55
2010/0319218 A1* 12/2010 Auger ..... A43B 7/16 36/36 B
2011/0078921 A1 4/2011 Greene et al.
2012/0192457 A1* 8/2012 Youngs ..... A43B 7/00 36/109
2012/0198721 A1 8/2012 Cavaliere
2012/0216422 A1* 8/2012 Ikezawa ..... A43C 1/00 36/83
2012/0317839 A1 12/2012 Pratt
2014/0259781 A1 9/2014 Sakai
2014/0283410 A1 9/2014 Marvin et al.
2015/0113830 A1 4/2015 Dillinger
2015/0150339 A1 6/2015 Van Hook
2016/0095383 A1* 4/2016 Surace ..... A43B 23/088 36/93
2016/0183635 A1 6/2016 Mancini
2017/0055630 A1 3/2017 Marshall
2017/0303632 A1* 10/2017 Pratt ..... A43B 3/248
2018/0084864 A1* 3/2018 Takada ..... A43B 7/1435
2018/0103727 A1* 4/2018 Fracassi ..... A43B 23/026
2018/0110288 A1 4/2018 Hatfield
2018/0110292 A1* 4/2018 Beers ..... A43B 11/02
2018/0206588 A1* 7/2018 Pratt ..... A43B 23/28
2018/0289109 A1 10/2018 Beers et al.
2019/0045884 A1* 2/2019 Uda ..... A43B 23/0205
2019/0116934 A1* 4/2019 Schenone ..... A43B 23/0235
2019/0297999 A1 10/2019 Nakaya et al.
2020/0085136 A1 3/2020 Pratt et al.
2020/0196703 A1 6/2020 Hopkins
2020/0196709 A1* 6/2020 Orand ..... A43B 7/14
2020/0196787 A1* 6/2020 Dament ..... A47G 25/82
2020/0205511 A1 7/2020 Hopkins et al.
2020/0205517 A1 7/2020 Happen
2020/0205520 A1 7/2020 Kilgore
2020/0253333 A1 8/2020 Kilgore et al.
2020/0305552 A1 10/2020 Cheney et al.
2020/0345098 A1* 11/2020 Xanthos ..... A43B 3/10
2020/0345105 A1 11/2020 Beers et al.
2021/0068493 A1 3/2021 Pratt et al.
2021/0204642 A1 7/2021 Kyle
2021/0204644 A1 7/2021 Kyle
2021/0282495 A1 9/2021 Davis et al.
2021/0378356 A1 12/2021 Cheney et al.

FOREIGN PATENT DOCUMENTS

CL 202302399 8/2023
CL 202302394 1/2024
CL 202302395 1/2024
CL 202302396 1/2024
CN 2925168 Y 7/2007
CN 101036540 A 9/2007
CN 100399958 C 7/2008
CN 101460070 A 6/2009
CN 201898951 U 7/2011
CN 102240088 A 11/2011
CN 102365035 A 2/2012
CN 102450770 A 5/2012
CN 102655776 B 9/2012
CN 102762121 A 10/2012
CN 102770039 A 11/2012
CN 104379014 A 2/2015
CN 104473371 A 4/2015
CN 204259964 4/2015
CN 204259964 U 4/2015
CN 105310186 A 2/2016
CN 105533927 A 5/2016
CN 105661719 A 6/2016
CN 104105424 B 8/2016
CN 106572722 A 4/2017
CN 112586837 A 10/2017
CN 107581703 1/2018
CN 108378466 8/2018
CN 108697196 10/2018
CN 108936966 12/2018
CN 108968234 A 12/2018
CN 208403416 1/2019
CN 109393642 A 3/2019
CN 109862801 6/2019
CN 109890236 A 6/2019
CN 107397292 B 3/2020
CN 212306984 1/2021
CN 112568548 A 3/2021
CN 113301824 A 8/2021
CN 215455754 1/2022
CN 215455754 U 1/2022
CN 215532079 U 1/2022
CN 114190654 A 3/2022
CN 114228214 A 3/2022
CN 114504166 A 5/2022
CN 114504167 A 5/2022
CN 114504168 A 5/2022
CN 216466141 U 5/2022
CN 114601230 A 6/2022
CN 114617336 A 6/2022
CN 109512082 7/2022
CN 114747839 A 7/2022
CN 217136975 U 8/2022
CN 217471364 U 9/2022
CN 217524082 U 10/2022
CN 217524104 10/2022
CN 217524104 U 10/2022

(56) References Cited

FOREIGN PATENT DOCUMENTS

| | | | |
|---|---|---|---|
| CN | 217658374 | U | 10/2022 |
| DE | 19611797 | A1 | 10/1997 |
| DE | 10019865 | A1 | 10/2001 |
| EP | 1212954 | | 6/2002 |
| EP | 1212954 | A1 | 6/2002 |
| EP | 2386217 | A2 | 11/2011 |
| EP | 2438826 | A1 | 4/2012 |
| EP | 2945507 | | 11/2015 |
| EP | 3501316 | | 6/2019 |
| EP | 3649881 | | 5/2020 |
| GB | 764640 | | 12/1956 |
| GB | 2321585 | | 8/1998 |
| JP | 11-187906 | A | 7/1999 |
| JP | 1999187906 | A | 7/1999 |
| JP | 1722701 | S | 8/2022 |
| JP | 7317385 | B2 | 7/2023 |
| KR | 102016091 | B1 | 8/2019 |
| NL | 2000762 | C1 | 1/2009 |
| WO | 2009154350 | A1 | 12/2009 |
| WO | 2013054358 | A2 | 4/2013 |
| WO | 2018217455 | A1 | 11/2018 |
| WO | 2020176653 | A1 | 9/2020 |

OTHER PUBLICATIONS

Examination report No. 1 for Australia patent application 2022362306, mailed Jul. 14, 2023.
Examination report No. 1 for Australia patent application 2023203319, mailed Jul. 14, 2023.
Examination report No. 1 for Canada patent application 3202848, mailed Jul. 31, 2023.
Examination and Search Report of CN Application No. 2021113470414 and Translation.
Examination and Search Report of CN Application No. 2022102356725 and Translation.
Examination and Search Report of CN Application No. 2022102433153 and Translation.
Examination and Search Report of Finland Application No. 20235646.
Examination and Search Report of Finland Application No. 20235905.
Examination Report of Sweden Application No. 23507387.
Examination Report of Sweden Application No. 23508062.
Examination Report of Sweden Application No. 23508070.
Examination Report of Taiwan Application No. 112204839 and Translation.
Examination Report of UK Application No. GB23092695.
PCTUS2022046726-IPRP.
Examination Report No. 1 for Australia patent Application 2023203320.
Examination Report No. 2 for Canada patent Application 3202848.
Registered Community Design (RCD) 008849293-0006.
Registered Community Design (RCD) 0015002956-0001.
Office Action for CL 202302373 dated Oct. 18, 2024.
Office Action for CL 202302394 dated Jun. 19, 2024.
Office Action for CL 202302394 dated Oct. 2, 2024.
Office Action for DE 11 2022 000 220.4 dated Sep. 18, 2024.
Office Action for DK BA 2024 00019 dated Jul. 30, 2024.
Office Action for DK PA 2024 70112 dated Jul. 1, 2024.
Office Action for DK PA 2024 70113 dated Jul. 1, 2024.
Office Action for DK 202470094 dated Feb. 19, 2025.
Office Action for FI U20244042 dated Sep. 5, 2024.
Office Action for GB2309269.5 dated Nov. 28, 2023.
Office Action for IL302899 dated Jul. 21, 2024.
Office Action for IL302945 dated Jul. 21, 2024.
Office Action for JP 2023-545807 dated Sep. 2, 2024.
Office Action for JP 2024-076941 dated Sep. 19, 2024.
Office Action for JP 2024-076942 dated Sep. 2, 2024.
Office Action for JP 2024-076943 dated Sep. 2, 2024.
Office Action for JP 2024-076943 dated Nov. 11, 2024.
Office Action for JP 2024-076944 dated Sep. 2, 2024.
Office Action for JP 2024-076944 dated Dec. 5, 2024.
Office Action for JP 2024-076945 dated Sep. 5, 2024.
Office Action for JP 2024-076945 dated Nov. 11, 2024.
Office Action for JP 2024-076946 dated Sep. 2, 2024.
Office Action for JP2024106472 dated Mar. 10, 2025.
Office Action for NO 20230930 dated Oct. 15, 2024.
Office Action for DK PA 2023 70318 dated Apr. 23, 2024.
Office Action for DK PA 2024 70056 dated May 23, 2024.
Office Action for DK PA 2024 70057 dated May 27, 2024.
Office Action for DK PA 2024 70097 dated May 17, 2024.
Office Action for PT 119409 dated May 13, 2024.
Office Action for PT 119410 dated Oct. 31, 2024.
Office Action for PT 119411 dated May 13, 2024.
Office Action for PT 119412 dated May 13, 2024.
Office Action for PT 119413 dated May 13, 2024.
Office Action for PT 119414dated May 13, 2024.
Office Action for PT 2023064568 dated Sep. 26, 2024.
Office Action for SE 2450381-5 dated Sep. 12, 2024.
Office Action for SE2550020 dated Jan. 30, 2025.
Office Action for SE25500216 dated Jan. 30, 2025.
Office Action for SE25500224 dated Jan. 3, 2025.
Office Action for TW 113200202 dated Aug. 22, 2024.
Office Action for TW113203110 dated Feb. 11, 2025.
Office Action for FI U20234070 dated Sep. 5, 2023.
Office Action for FI U20234088 dated Sep. 5, 2023.
Office Action for FI U20234089 dated Sep. 5, 2023.
Office Action for FI U20244001 dated Mar. 19, 2024.
Office Action for FI U20244021 dated Apr. 12, 2024.
Office Action for FI U20244022 dated Apr. 12, 2024.
Office Action for FI U20244023 dated Apr. 12, 2024.
Office Action for FI U20244024 dated Apr. 12, 2024.
Office Action for FI U20244025 dated Apr. 12, 2024.
Office Action for TW UM 112204837 dated Jun. 28, 2024.
Patent Search Report for CN 2023224233436 dated Oct. 14, 2024.
Patent Search Report for CN 2024202204093 dated Nov. 4, 2024.
Patent Search Report for CN 2024202256261 dated Nov. 4, 2024.
Patent Search Report for CN 2024202334504 dated Nov. 10, 2024.
Patent Search Report for CN ZL202322420336.0 dated May 16, 2024.
Search Report for GB 2403555.2.
Search Report for EP 24162985.6.
Technical Evaluation Report for TW UM 113203111.
Technical Evaluation Report for TW 113200202 dated Sep. 18, 2024.
Technical Evaluation Report for TW 112210175.
Technical Evaluation Report for TW 112204839.
Observation for HK 52024085853.7.
Observation for HK 52024085854.5.
Observation for HK 52024085855.2.
Observation for HK 52024085856.0.
Office Action and Search Report for FI 20245362.
Office Action and Search Report for FI 20245364.
Office Action and Search Report for FI 20245366.
Office Action and Search Report for FI 20245367.
Office Action and Search Report for FI 20245374.
Office Action and Search Report for SE 2450280-9.
Office Action for TW 112118133 dated Aug. 1, 2024.
Office Action for TW 112204837 dated Aug. 23, 2023.
Office Action for TW 112204838 dated Jul. 28, 2023.
Office Action for TW 112204838 dated Oct. 25, 2023.
Office Action for TW 112204839 dated Jul. 13, 2023.
Office Action for TW 112210168 dated Dec. 27, 2023.
Office Action for TW 112210175 dated Oct. 30, 2023.
Office Action for TW 113200202 dated Mar. 6, 2024.
Office Action for TW 113203110 dated May 17, 2024.
Office Action for TW 113203111 dated Apr. 30, 2024.
Office Action for TW 113203112 dated May 6, 2024.
Technical Evaluation Report for TW 112204838.
Office Action for DE 20 2022 002 993.4 dated Apr. 12, 2024.
Office Action for CN 2021113470414 dated Jun. 12, 2024.
Office Action for CN 2022102356725 dated Jun. 12, 2024.
Office Action for CN 2022102433153 dated Oct. 23, 2023.
Office Action for CL 202302397 dated Apr. 8, 2024.
Office Action for CL 202302398 dated Apr. 9, 2024.
Office Action for CL 202302399 dated Apr. 9, 2024.

(56) References Cited

OTHER PUBLICATIONS

Office Action for CN 202322423343.6 dated Apr. 2, 2024.
Office Action for FI 20235646 dated Nov. 2, 2023.
Office Action for FI 20235903 dated Dec. 13, 2023.
Office Action for FI 20235905 dated Feb. 12, 2024.
Office Action for GB 2400731.2 dated Feb. 12, 2024.
Search and Examination Report for GB 2400732.0 dated Feb. 12, 2024.
Office Action for SA 523450971 dated Jul. 4, 2024.
Office Action for SA 523450973 dated May 31, 2024.
Office Action for SA 523450976 dated May 31, 2024.
Office Action for AU 2024202506 dated May 24, 2024.
Search Report for EP 24164584.5.
Office Action for DK BA 2023 00036 dated Oct. 23, 2023.
Office Action for DK BA 2024 00017 dated May 15, 2024.
Office Action for DK BA 2024 00018 dated May 15, 2024.
Office Action for DK BA 2024 00020 dated May 15, 2024.
Office Action for CH000761/2023 dated Jul. 9, 2024.
"Footwear Press 2021, No. 6" vol. 63, No. 6, Total No. 744, Jun. 1, 2021, Published by F-WORKS Co., Ltd.
EESR for EP24162975.7 dated Jul. 1, 2024.
EESR for EP24164572.0 Jul. 5, 2024.
EESR for 24164584.5 Jul. 1, 2024.
EESR for EP 24162994.8 dated Jul. 1, 2024.
Examination Report and Search Report for SE 2350806-2.
Examination Report and Search Report for SE 2350807-0.
Examination Report and Search Report for SE 2450279-1.
Examination Report and Search Report for SE 2450281-7.
Examination Report and Search Report for SE 2450380-7.
Examination Report and Search Report for SE 2450381-5.
Examination report for PT 12258.
Examination report for PT 12259.
Examination Report for ES 202331459.
Examination Report for ES 202331460.
Examination Report for ES 202430475.
Third Party Prior Art Submission for JP 2024-076943 dated Nov. 12, 2024.
Third Party Prior Art Submission for JP 2023-545807 dated Dec. 2, 2024.
Third Party Observation for KR 2024-7000036 dated Sep. 27, 2024.
Examination Report for AU 2024223994 dated Dec. 4, 2024.
Third Party Observation for KR 2024-7000011 dated Sep. 27, 2024.
Extended European Search Report for 22881838.1.
Extended European Search Report for 24155788.3.
Extended European Search Report for 24156589.4.
Extended European Search Report for EP 24162953.4.
First Examination Report for AU 2024223994 dated Oct. 22, 2024.
First Examination Report for NZ 800446 dated Oct. 29, 2024.
First Examination Report for NZ 800553 dated Oct. 29, 2024.
First Examination Report for NZ 800554 dated Oct. 29, 2024.
First Formal Notification for PT 12300.
First Formal Notification for 12301.
Third Party Observation for KR 2024-7000010 dated Sep. 27, 2024.
Notice of Allowance for UM 113200202 TW.
Notice of Correction for HK 52024085852.9.
Notice of Correction for HK 52024085853.7.
Notice of Correction for HK 52024085854.5.
Notice of Correction for HK 52024085855.2.
Notice of Correction for HK 52024085856.0.
Notice of Correction for HK 52024085857.8.
Notice of Correction for HK 52024085858.6.
Notice of Correction for HK 52024085859.4.
Notice of Preliminary Rejection for KR 2023-7000036.
Notice of Preliminary Rejection for KR 2024-7000010.
Notice of Preliminary Rejection for KR 2024-7000011.
Notice of Preliminary Rejection for KR 2024-7000012.
Notice of Preliminary Rejection for KR 2024-7000014.
Notice of Preliminary Rejection for KR 2024-7000015.
Notice of Preliminary Rejection for KR 2024-7000016.
Notice Of Preliminary Rejection_KR20237000036_dated Mar. 21, 2025.
Office Action for JP2025016194 dated Oct. 16, 2025.
William A. Rossi, D.P.M., The Complete Footwear Dictionary, 2000, pp. 1-217, Second Edition, Krieger Publishing Company, Malabar, Florida, U.S.A.
Richard Taylor, St Crispin and the "Winkle-Pickers", The Scotsman, Oct. 15, 1960, p. 10, National World Publishing Ltd., Edinburgh, Scotland.
Wade Motawi, Shoe Material Design Guide, Dec. 26, 2017, pp. 1-194, Wade Motawi, Carlsbad, California, U.S.A.
J. Sparkes Hall, The Book of the Feet: A History of Boots and Shoes, 1847, pp. 1-216, J.S. Redfield, New York, U.S.A.
Victorian Shoes in the Making available at https://www.victorianpassage.com/2008/12/victorian_shoes_in_the_making/ pp. 1-9.

* cited by examiner

FOOTWEAR HEEL COUNTER FOR EASIER FOOT ENTRY OR REMOVAL

CROSS REFERENCE TO RELATED APPLICATIONS

This application is a divisional application of U.S. application Ser. No. 18/199,262, filed on May 18, 2023, which claims the benefit of priority to International Application No. PCT/US2022/46726, filed on Oct. 14, 2022, which claims the benefit of priority to U.S. Provisional Patent No. 63/256,521, filed on Oct. 15, 2021. These applications are hereby incorporated by reference in their entireties.

TECHNICAL FIELD

The present disclosure generally relates to a heel counter or a component of a heel counter of a shoe, and in particular a heel counter that is designed to allow for easier entry of the wearer's foot into the shoe.

BACKGROUND

Conventionally, when donning footwear such as sports shoes, the user must often use one or both hands or operate a shoehorn separate from the shoe to properly insert the foot into the shoe and secure the quarter from collapsing under the heel.

BRIEF SUMMARY OF DISCLOSURE

Aspects of this invention relate to an article of footwear that has a structure capable of distortion to support easier foot insertion.

In one aspect of the invention, a heel cup may be uniformly molded with an upper portion, midportion, and lower portion, and the upper portion has a smaller mediolateral length than the midportion. The midportion and lower portion may form a concave structure configured to receive the heel. The upper portion of the heel cup has a first configuration in its native state and is capable of distorting into a second configuration under a load of a user's foot when the user is donning the footwear. In the second configuration, at least part of the upper portion is lowered relative to the first configuration and the upper portion is capable of returning to the first configuration after the load of the user's foot is removed. The midportion may include a peripheral portion having a first thickness and a central portion having a second thickness, and the second thickness is less than the first thickness.

In another aspect of the invention, the upper portion of a heel cup has a first configuration in its native state and is capable of distorting into a second configuration under a load of a user's foot when the user is donning the footwear and the heel cup is capable of returning to the first configuration after the load of the user's foot is removed. In the first configuration, the upper portion has a downward incline with a first angle relative to a vertical line that is normal to a horizontal surface of the floor, and the upper portion in the second configuration has an incline with a second angle greater than the first angle. Additionally, in the second configuration, a lower region of a central portion of the heel cup extends outward in a direction away from the shoe opening that causes the shoe opening to widen along the mediolateral direction.

In another aspect of the invention, an upper of an article of footwear includes a U-shaped foamed ankle collar that is substantially tubular in shape and forms the topmost region of the foot receiving shoe opening. The foamed ankle collar may extend at least partially around and over the foot receiving shoe opening and may be compressed by the user's heel during foot insertion. The ankle collar may exert pressure on the user's ankle once the foot is inserted into the footwear. The ankle collar may also have a flattened region along its length forming a downward angle from the topmost region toward the front of the article of footwear.

In another aspect of the invention, a heel counter support is located on the upper and above the sole structure. The heel counter support may have at least two hollow receptacles with backward angles. Additionally, each one of the two hollow receptacles receive one end of a compressible component. The compressible component has a first configuration in its native state, and the compressible component is capable of distorting into a second configuration under a load of a user's foot when the user is donning the footwear and is capable of automatically returning to the first configuration after the user's foot in fully inserted into the footwear.

BRIEF DESCRIPTION OF THE DRAWINGS

By way of example only, selected embodiments and aspects of the present invention are described below. Each description refers to a figure ("FIG.") which shows the described matter. Some figures shown in drawings or photographs that accompany this specification may be for footwear that is for either the left or right foot. Each figure includes one or more identifiers for one or more part(s) or elements(s) of the invention.

Various embodiments are described with reference to the drawings, in which:

in FIG. 18.

DETAILED DESCRIPTION

Figure 1:
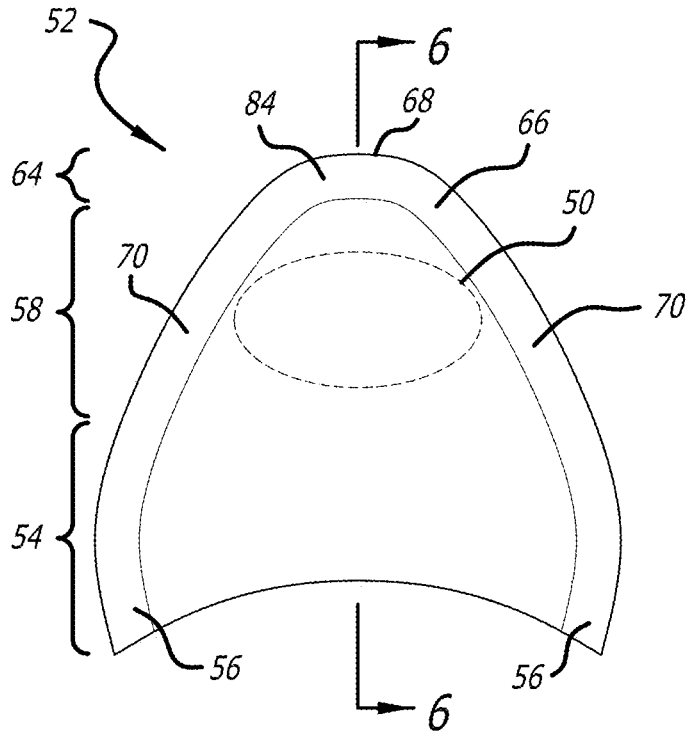
FIG. 1 is a front view of a compressible heel cup.

A shoe may comprise a sole and an upper. The sole may comprise an outsole, a midsole, and/or an integrally formed outsole and midsole. The upper may comprise a toe box, a vamp, a tongue, a medial quarter, a lateral quarter, and a heel counter. The shoe has a forefoot portion, a rear portion, a medial side and a lateral side. The upper may comprise an exterior layer, interior layers or interior structure, and/or an inner lining. The upper may form a shoe opening that is capable of receiving a user's foot when the user is donning the shoe.

The heel counter or rear portion of the upper may comprise a structure(s) that enables easier insertion of the foot into the shoe opening. The structure(s) may also support easier removal of the foot. The heel counter or rear portion of the upper may further have a transient widening when the user is donning or removing the shoe. The widening of the shoe opening may be initiated by the user placing a load on the heel counter or rear portion of the upper that may be exerted by the user's foot with minimal to no assistance by the user's hands. In other embodiments of the invention, the heel counter may be compressible when placed under sufficient load and return to its uncompressed stated. The lowering of the heel counter may also allow easier insertion of the user's foot. Once a foot is inserted into the shoe, the heel counter may have a compressible layer, such as a foam component, that secures or enhances securement of the foot during user's normal wear of the shoe.

Compressible Heel Cup. Referring to the embodiments of FIGS. 1-10 a heel counter 32 may comprise a compressible heel cup 52 which may be an interior component of the upper 16, a portion of the inner lining 46 or an attachment adjacent to the inner lining 46 of the upper 16 such that the heel cup 52 makes contact with the foot, or a portion of the exterior layer 42 of the upper 16 or an attachment of an outer surface of the exterior layer 42 of the upper 16.

Figure 2:
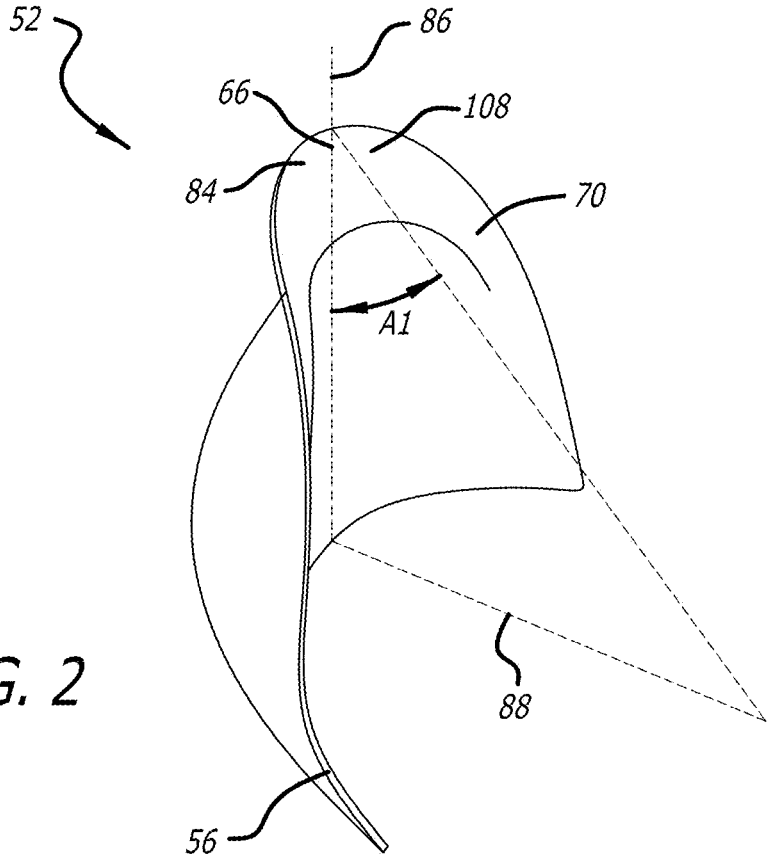
FIG. 2 is a perspective view of the compressible heel cup of FIG. 1.
Figure 3:
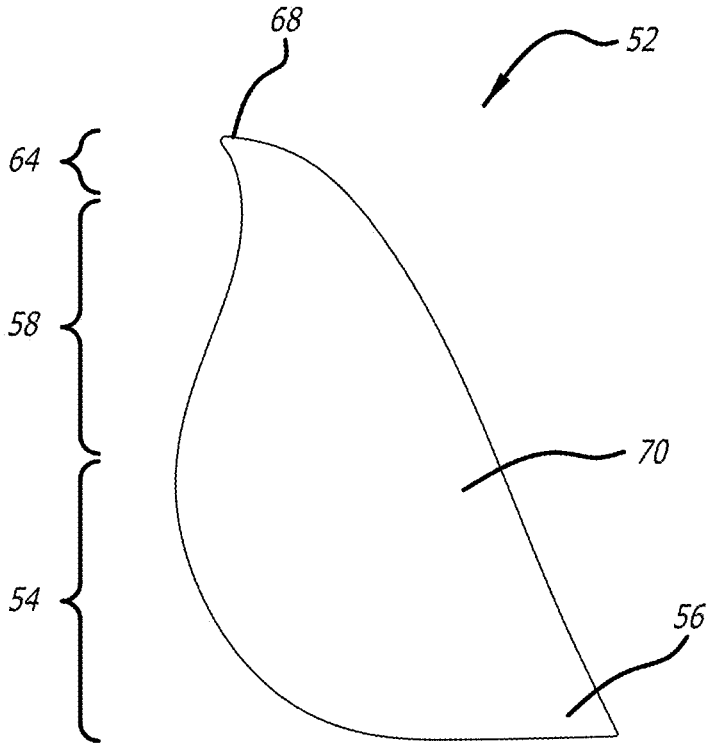
FIG. 3 is a side view of the compressible heel cup of FIG. 1.

Referring to the exemplary embodiment of FIGS. 1-4, the heel cup 52 has a shape substantially corresponding to a heel covering and having a profile resembling a pear-like shape. The heel cup has a mediolateral width near the heel cup collar 84 that is less than the mediolateral width of the lower portion 54 as shown in FIGS. 1-2

As shown in FIG. 2, the inner wall 66 of the upper portion 64 of the heel cup at the rearmost portion of the heel cup may have a downward incline of between 0 to 90 degrees relative to a vertical line 86 that is normal to the horizontal surface 88 of the floor. In this exemplary embodiment, the inner wall 66 of the upper portion 64 may have a downward incline of 30 degrees. The inner wall 66 of the upper portion 64 of the heel cup 52 may also have a convex curvature facing toward the shoe opening 48. The top portion of the convex curvature has the downward incline A1 of 30 degrees. The lower portion of the convex curvature extends just above the portion of the heel cup 52 that receives the heel. The lower portion of the convex curvature may have a downward incline less than the downward incline of A1 and gradually decreases as it approaches an incline equal to the vertical line 86. The heel cup 52 has a concave curvature that surrounds the rear portion of the heel. The medial and lateral sides of the heel cup 52 may also extend and form support of part of the quarter and even as far as the vamp.

The thickness of the heel cup 52 may be reduced at various locations. The top edge line 68 may have a tapering of the inner surface of the heel cup 52 and outer surface of the heel cup 52. The heel cup 52 may have increased thickness T1 along the other perimeter edges, such as 2 to 3 mm. In another exemplary embodiment, the thickness T1 may be reduced in certain areas to provide greater flexibility to the heel cup 52 when donning or removing the shoe 12. In one embodiment, the thickness T1 of the heel cup 52 may decrease gradually from a peripheral portion 70 forming an area at the periphery of the heel cup 52 toward the central portion or region 50 of the mid-portion 58. The minimum thickness T1 in the central region 50 of the mid-portion 58 may be approximately, but not limited to ¼ to ⅙ the thickness relative to the thickest portions at the periphery of heel cup 52, such as 0.5 to 1 mm. The thickest region of the top portion may be greater than the thickest region of the bottom portion. The reduced thickness T1 of the central region of the mid-portion 58 may allow for the heel cup 52 to compress under sufficient load. In an alternate embodiment, the thickness T1 may be reduced across the entire mediolateral portion or in multiple regions such as regions in the mid-portion 58 and/or regions of the upper portion 64. The thinner regions may provide increased flexibility and bending of the heel cup 52 which provides the necessary compressibility under the load of a user's foot such as during the donning of a shoe 12. Such compression may allow the upper portion 64 and/or the mid-portion 58 of the heel cup 52 to move rearward and widen the shoe opening 48 to allow easier entry of the foot. The heel cup 52 is capable of distortion from a first configuration in its native state, to a second configuration under a load of a user's foot when the user is donning the footwear. For example, the heel cup 52 may be partially compressed such that the upper portion 64 and/or mid-portion 58 of the heel cup 52 is lowered sufficiently to allow the insertion of the user's foot. See for example FIGS. 4A and 4C. Once the user's foot is inserted into the shoe 12, the heel cup 52 may return to its uncompressed configuration.

Figure 4A:
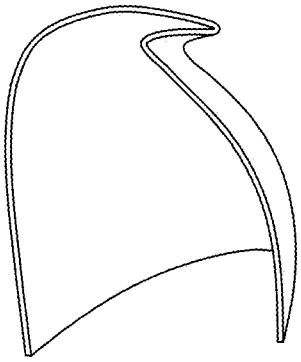
FIGS. 4A and 4B are a side-by-side front perspective view of the compressible heel cup of FIG. 1 in its compressed configuration (4A) and its uncompressed configuration (4B).
Figure 4B:
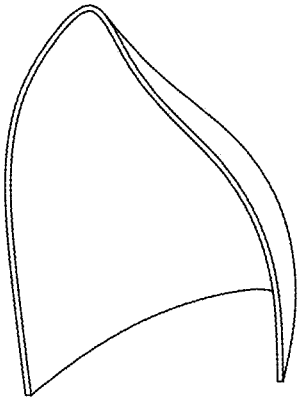
Figure 4C:
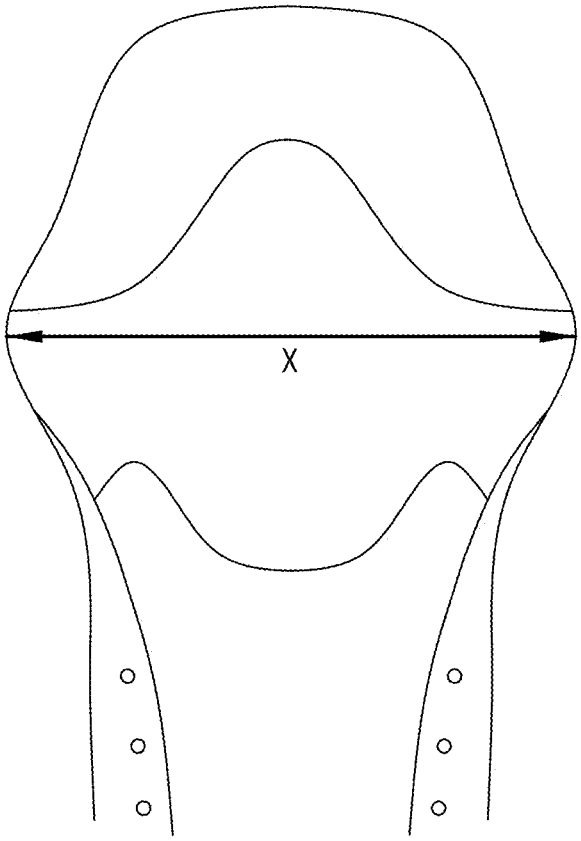
FIGS. 4C and 4D are a side-by-side top view of the compressible heel cup of FIG. 1 placed within a shoe in its compressed configuration (4C) and its uncompressed configuration (4D).
Figure 4D:
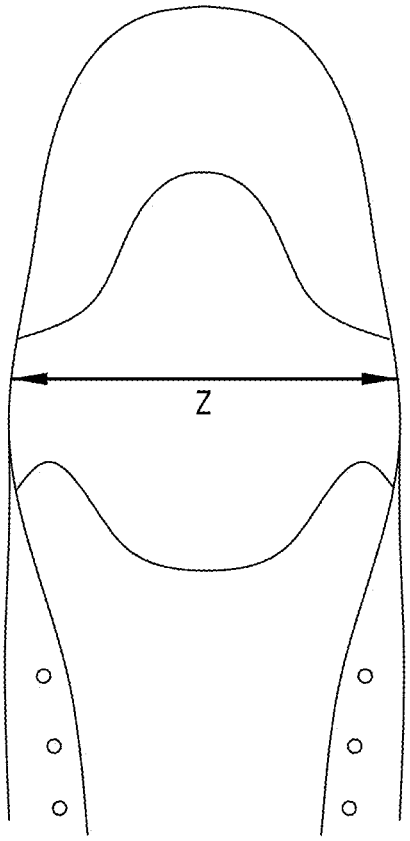

Further to this embodiment, when a user dons the shoe 12, the top portion of the convex curvature of the heel cup 52 or the uppermost segment of the heel counter 32 of the shoe 12 may be lowered and extend backward away from the foot as the heel counter 32 is compressed as shown in FIG. 4A. This action allows the user's foot to be inserted into the shoe opening 48 with a reduced degree of plantar flexion. During compression of the heel cup 52, portions of the heel cup 52 may move forward toward the direction of the forefoot portion. The distortion of the heel cup 52 may include the attached heel counter 32 widening with the medial and lateral sides of the heel cup moving outward thereby widening the opening of the shoe. The mediolateral widening of the shoe opening 48 allows easier entry such as easier insertion of the forefoot portion of the user's foot. In one exemplary embodiment, the shoe opening of 7.5 cm may widen up to 4 cm or about 50%. See FIGS. 4C and 4D. The widening may be less or more depending on the size of the shoe and the flexibility of the heel cup. In some shoes, the desired widening may be less or greater depending on the needs of securement and use.

In an exemplary embodiment of the heel cup 52 as shown in FIGS. 1-4, the thickness T1 of a heel cup 52 made of a polymer material, such as Dupont Hytrel, may range from 0.4 millimeters to 4 millimeters. The range of thickness T1 of the heel cup may be thinner or thicker at various regions depending on the desired elastic and durable properties of the material. For example, the midpoint region may be thinner than the surrounding regions, and in particular a central portion may be thinner as shown in FIG. 6B. The central portion may be spaced away from the medial and lateral edges wherein the peripheral edges may have a greater thickness. Other suitable materials may include other thermoplastic elastomers or other polymers capable of providing the compressible characteristics of the heel cup.

Figure 5:
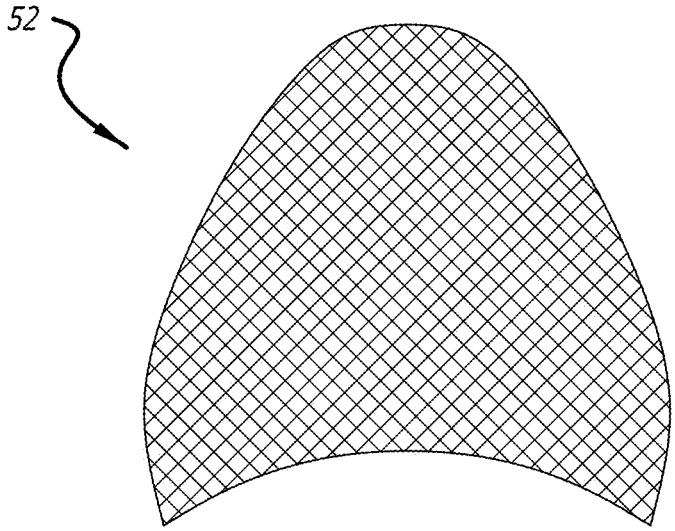
FIG. 5 is a front view of a heel cup configured to have a series of crisscross beams.

In another exemplary embodiment, the heel cup may be configured to have a series of crisscross beams that form an egg crate like configuration. FIG. 5 shows an exemplary embodiment with beams that are in a diagonal configuration. In an alternate embodiment, the beams may also be in a vertical and lateral configuration. The apertures between the beams may be approximately uniformly sized. The beams may be uniform in dimensions or vary in thickness and width. Beams that are thinner or less wide may be used to enhance flexibility and compressibility in designated locations while thicker or wider beams provide varying degrees of rigid support. For example, the beams may be thinner in the mid-portion, and in particular, the central portion of the mid-portion that is spaced away from the edges. The surrounding beams may be thicker than the central portion. The central portion may allow for greater flexibility in order to distort under a load.

Figure 6A:
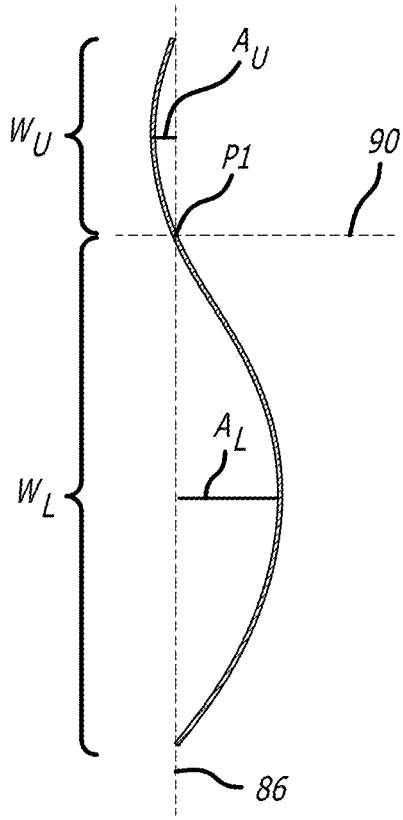
FIG. 6A is a schematic illustration of a cross-section of arc lengths of the rearmost portion of the heel cup of FIG. 1.
Figure 6B:
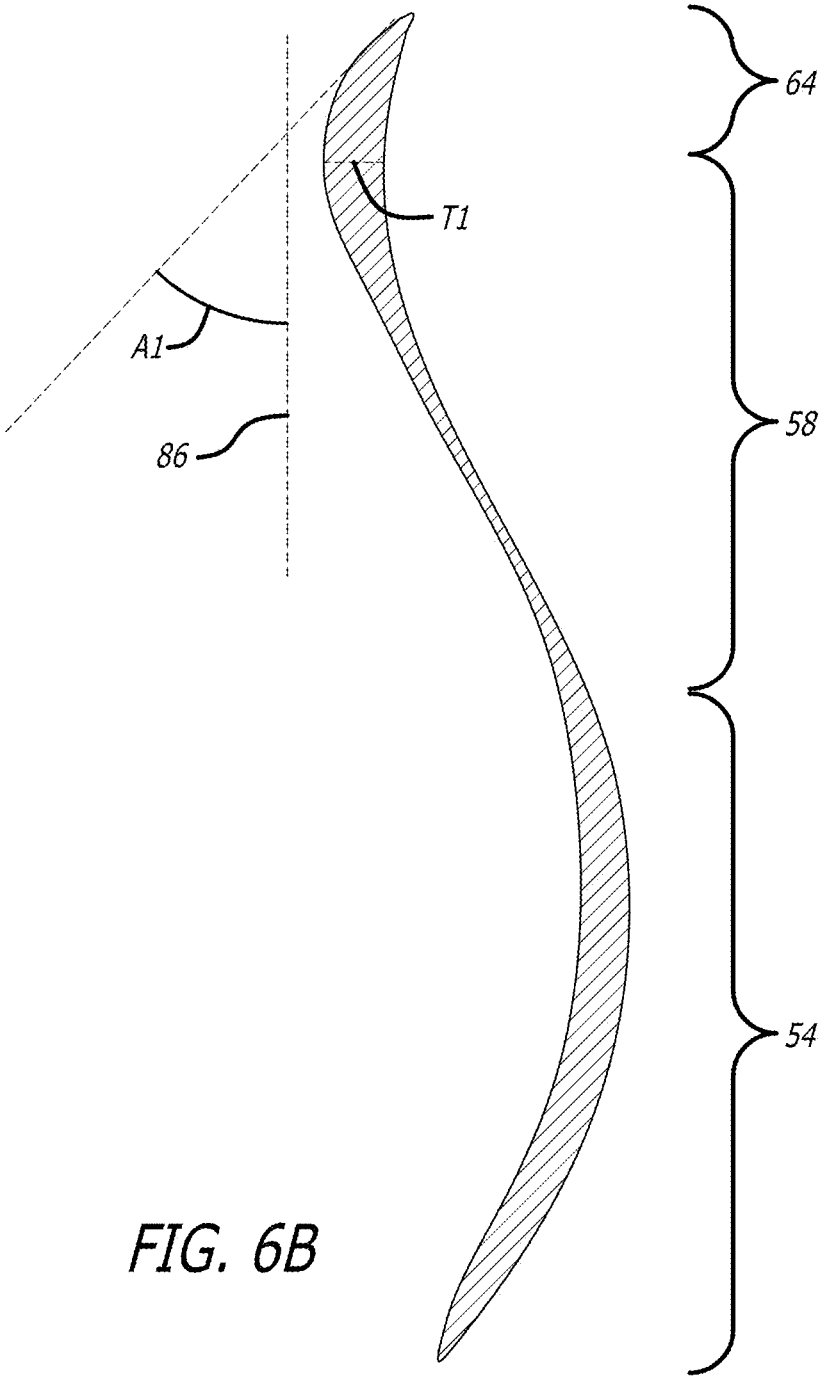
FIG. 6B is cross-sectional view of the heel cup of FIG. 1 taken at lines 6-6 in FIG. 1.
Figure 7:
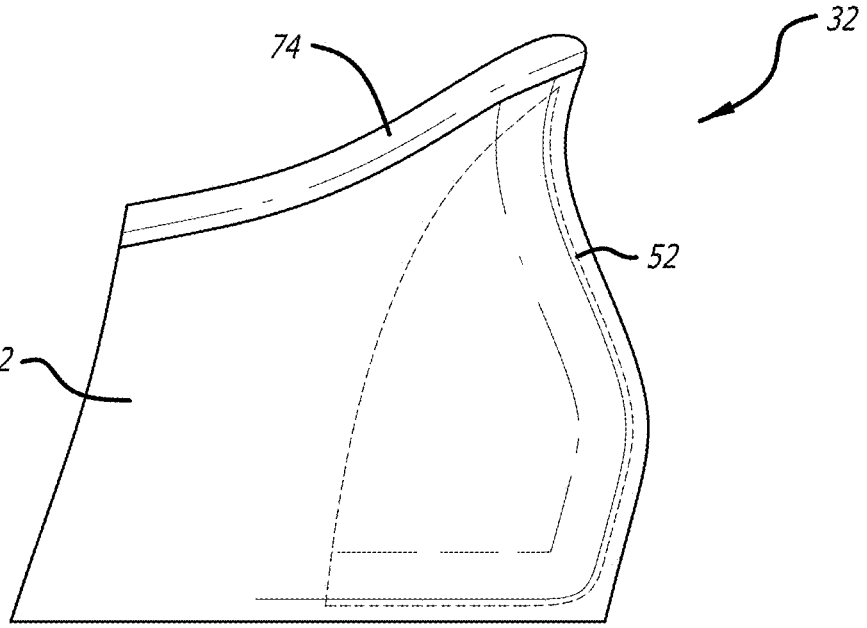
FIG. 7 is a side view of a heel counter with a heel cup located in the interior of the heel counter.
Figure 8:
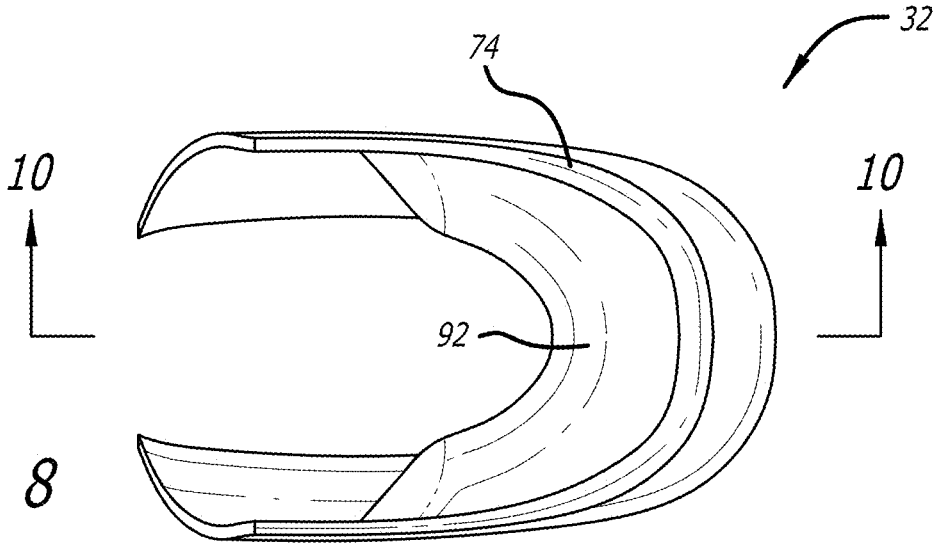
FIG. 8 is a top view of the heel counter of FIG. 7.
Figure 9:
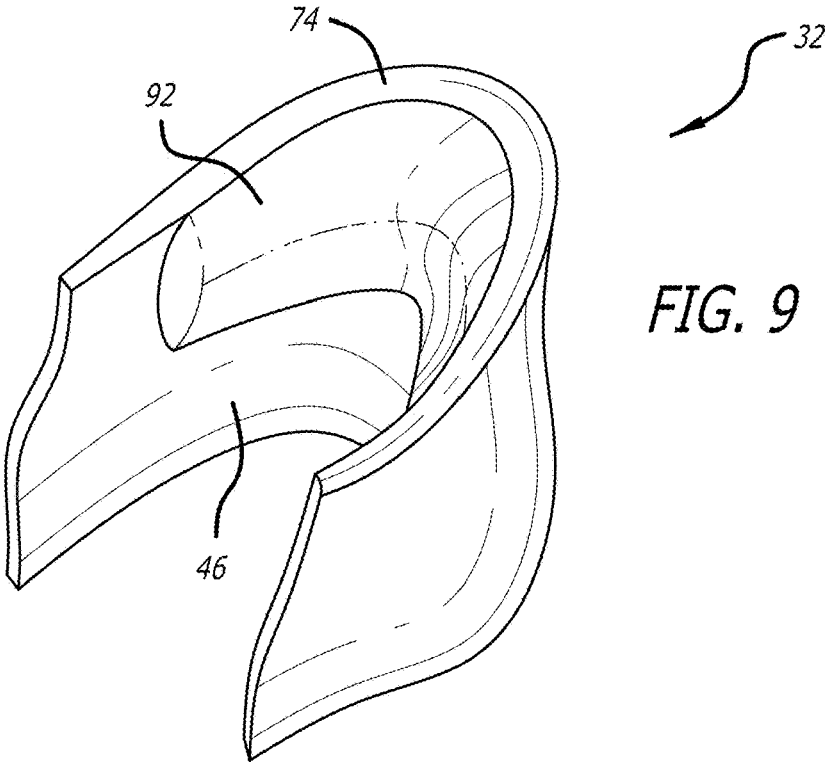
FIG. 9 is a perspective view of the heel counter of FIG. 7.

In an exemplary embodiment, the rearmost portion of the heel cup 52 may have an overall vertical cross-sectional shape that resembles approximately an S wave as shown on a cross-sectional diagram of FIG. 6A. The upper and lower portions of the S wave may be differentiated at the point P1 through a horizontal plane, i.e. the midline 90, which is drawn between the upper arc and lower arc ends of the S wave and intersects the heel counter 32 and the inflection point of the S wave. The amplitude ($A_U$) and width ($W_U$) of arc of the upper portion of the S wave may be different than the amplitude ($A_L$) and width ($W_L$) of the lower arc of the lower portion of the S wave. In the exemplary embodiment, the $W_U$ is approximately 0.44 times that of the $W_L$. The $A_U$ is approximately ⅓ that of the $A_L$. In one possible embodiment, the $W_U$ is approximately 2 centimeters and the $W_L$ is approximately 4.5 centimeters. The $A_U$ is roughly 3 millimeters and the $A_L$ is roughly 9 millimeters. The S configuration decreases both in $A_U/A_L$ and $W_U/W_L$ in the cross-sections in the areas extending from the rearmost portion's cross-section of the heel cup 52 and may only consist of the lower portion arc along the medial and lateral sides of the heel cup 52. The measurements at the rearmost portion of the heel cup 52 of the exemplary embodiment are intended to be exemplary.

The central region of the mid-portion of the heel cup may have a single aperture or a plurality of apertures. Just as the central region of the mid-portion may be constructed with less material than the maximum thickness of the collar and/or the maximum thickness of the base, the central region of the mid-portion of the heel cup may be constructed with a material of greater flexibility than the material forming its periphery. The resulting effects of the central region comprising a single aperture, a plurality of apertures, a lesser thickness, and/or a material of greater flexibility, may serve to facilitate entry and removal of the user's foot from the shoe.

Figure 10:
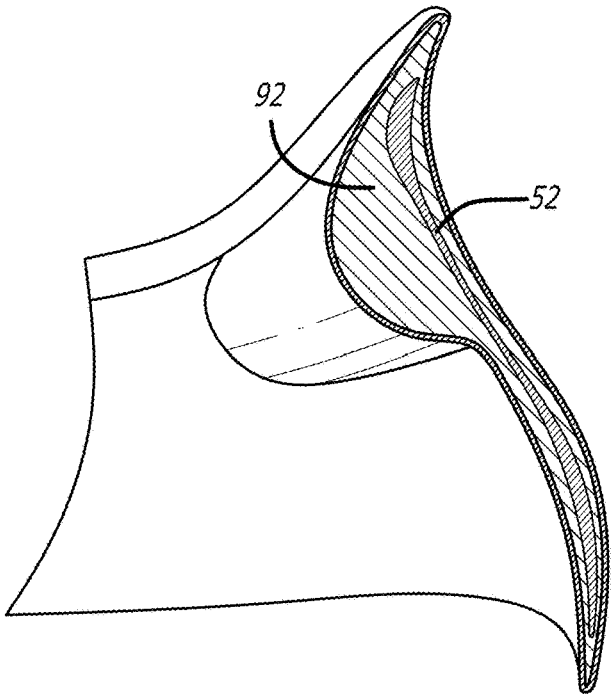
FIG. 10 is a cross-sectional view of the heel counter of FIG. 8 taken at lines 10-10 in FIG. 8.

Further to the exemplary embodiment, the heel cup 52 may be attached at least to an interior foam layer 92, as shown in FIG. 10. The heel cup 52 may be located in the interior of the heel counter 32 of the upper 16 as shown in FIGS. 7-10. The foam layer 92 may line both the inner wall 66 of the heel cup 52 and outer wall of the heel cup 52. Around the upper portion and mid-portion, the foam layer 92 may protrude and extend further into the shoe opening 48. The foam layer 92 may be thicker at or adjacent to the upper portion 64 and mid-portion 58 of the heel cup 52 thereby forming part of the cuff of the shoe opening 48. The thicker foam layer 92 may provide securement of the user's foot once inserted within the shoe 12 as the foam would be located above the calcaneus bone region of the user's foot and extend around at least portions of the ankle region of the foot. Since the foam is compressible, the foam may be compressed by the heel during foot insertion or removal and hold the ankle of the user's foot once the foot is inserted.

Figure 11:
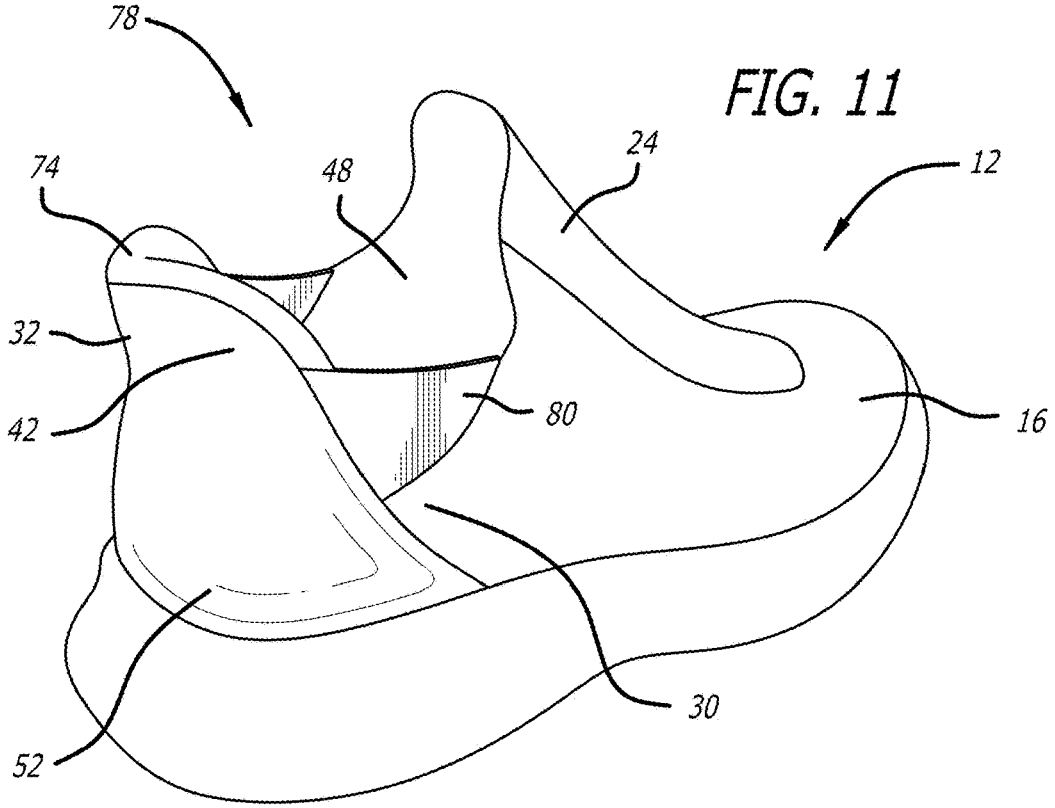
FIG. 11 is a perspective view of a shoe with a heel counter incorporating a rigid heel cup.
Figure 12:
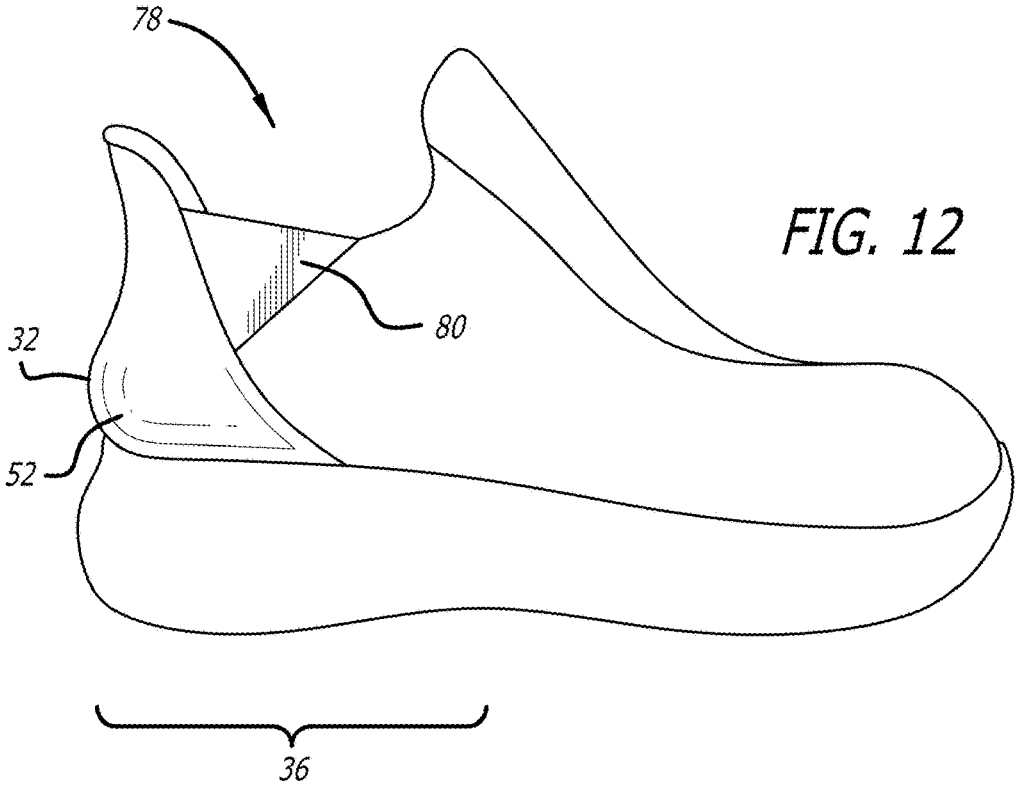
FIG. 12 is a side view of the shoe of FIG. 11.
Figure 13:
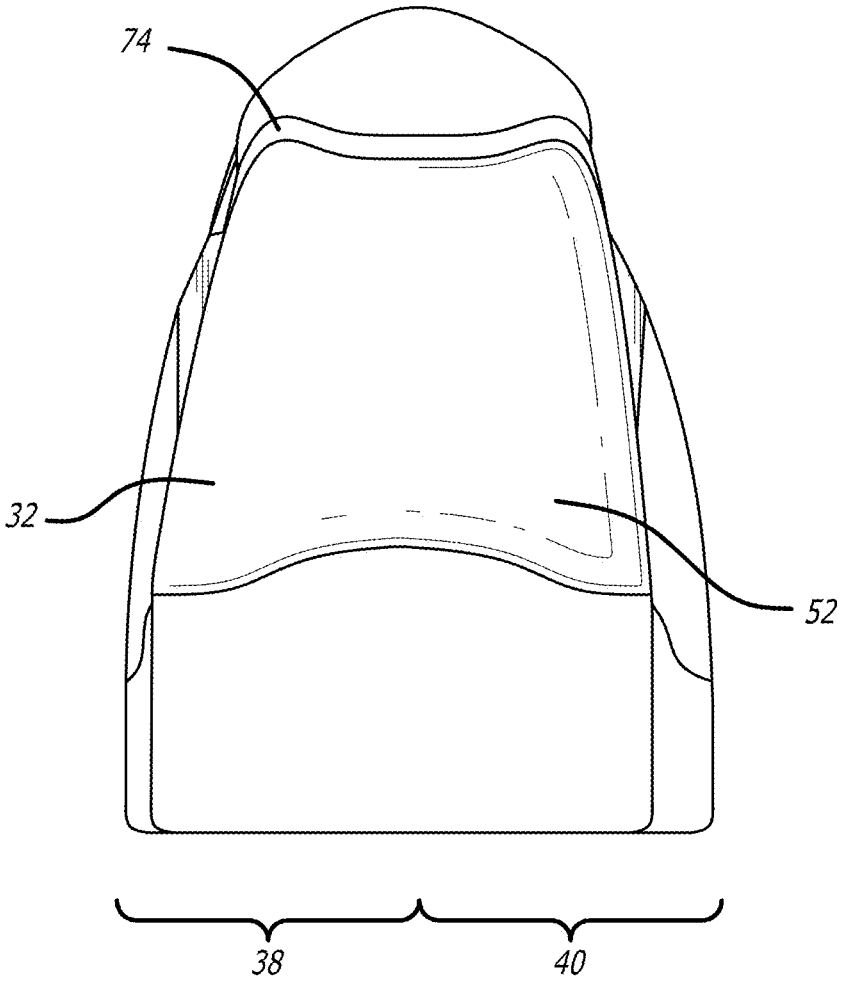
FIG. 13 is a rear view of the shoe of FIG. 11.

Rigid Heel Cup. In one exemplary embodiment, a shoe 12 may have a heel counter 32 located at the rear portion 36 of a shoe upper 16 as shown in FIGS. 11-13. The heel counter 32 may comprise a heel cup 52 which may be an interior component of the upper 16, a portion of the inner lining 46 or an attachment adjacent to the inner lining 46 of the upper 16 such that the heel cup 52 contacts the foot, or a portion of the exterior layer 42 of the upper 16 or an attachment of an outer surface of the exterior layer 42 of the upper 16.

The heel cup may have a lower portion that forms a heel cup configured to receive the heel of the foot. The lower portion of the heel cup may further have side extensions around both the medial side and lateral side. The heel cup may have a mid-portion located above the lower portion of the heel cup and that curves inward above the heel bone or may be composed of an aperture. The heel cup may have an aperture located at the rear of the heel cup. Further to this embodiment, the heel cup may be a rigid heel cup constructed of a substantially incompressible material under the load of the foot.

At least one aperture may be incorporated into the mid-portion of the rigid heel cup that may be added to enhance the fit of the shoe around the foot of the heel. The upper material layers covering the aperture may comprise an elastic material such that the material stretches around the contours of the heel. The tension created by the elastic material upon stretching may enhance the securement of the foot during normal use of the shoe.

The upper portion of the heel cup may be configured with a smooth curvature extending from the top edge of the heel cup curved downward towards the shoe opening 48. The inner wall of the upper portion has an overall downward incline that extends from the curved top edge of the upper portion toward the interior of the upper 16. The inner wall of the upper portion may have dimensions akin to a shoehorn such that the smooth curvature and angle of the downward incline of the upper portion allows the heel of the foot to slide into the shoe 12 with greater ease. The heel cup may be constructed of a rigid material that does not substantially compress under the load of the user's foot. In an alternate embodiment, the heel cup may have some flexibility such that the upper portion of the heel cup may have some slight flexibility sufficient to bend downward and away from the shoe opening and/or widen the shoe opening 48 for easier foot insertion and/or removal.

As shown in FIG. 11, the top edge of the heel counter 32 may also form a resilient support structure of the rear heel collar 74. When the heel cup 52 is incorporated into the upper 16, a fabric material(s) or a suitable material(s) known in the art may be used to cover the heel cup 52 thereby forming the exterior layer 42 and interior layers or structures of the upper. The fabric material may extend above the heel cup 52 thereby forming an extension of the heel collar 74.

Foam material or any inner lining material(s) known in the art may be used as an inner compressible layer of the upper 16 of FIG. 11. The foam material may be bonded to the inner surface of the heel cup 52 to provide cushioning against the rigid heel cup material. The thickness of the foam material may be uniform or vary at certain locations depending on the desired cushioning or support to the foot. In one exemplary embodiment, thicker foam material may be located at the inner wall 66 of the upper portion 64 and may further extend at least a portion along the mediolateral length of the inner wall 66. The foam material may be configured to curve around at least a portion of the ankle above the heel when the shoe 12 is worn similar to the foam material configuration shown in FIG. 10. In this embodiment, the user's foot may compress the foam material during foot insertion. Following foot insertion, the foam material may expand to its fully uncompressed state or partially expand thereby improving the security of the foot within the shoe 12. A thinner foam material may be used to line the other portions of the heel cup 52.

The rigid heel cup 52 may be used in combination with a shoe upper 16 having at least one elastic region 78 located on the sides of the upper between the heel cup 52 and the front portion of the foot receiving shoe opening 48. The elastic region 78 may have one or more elastic materials that allow the rear portion of the heel counter 32 to be temporarily moved back to widen the foot receiving shoe opening 48 for easier insertion of the foot into the shoe 12. As shown in FIG. 11, the elastic material may be a gore piece 80 configured to be fixed within a void of the upper such as in the form of a gusset on the medial quarter or lateral quarter or both. The elastic material may be in any spacing between the heel cup 52 and the upper portion located at the quarters 30 or vamp 24 or possibly a tongue. The elastic material may also be configured as a series of elastic strips or webbing extending between the heel cup 52 to the medial and lateral sides of the vamp 24 or possibly a tongue.

Instep Support. In some embodiments, an instep support may be used to aid in preventing, in some instances, the instep of the user's foot from dragging a portion of the instep, or tongue partially into the throat area as the user dons the shoe.

Figure 14:
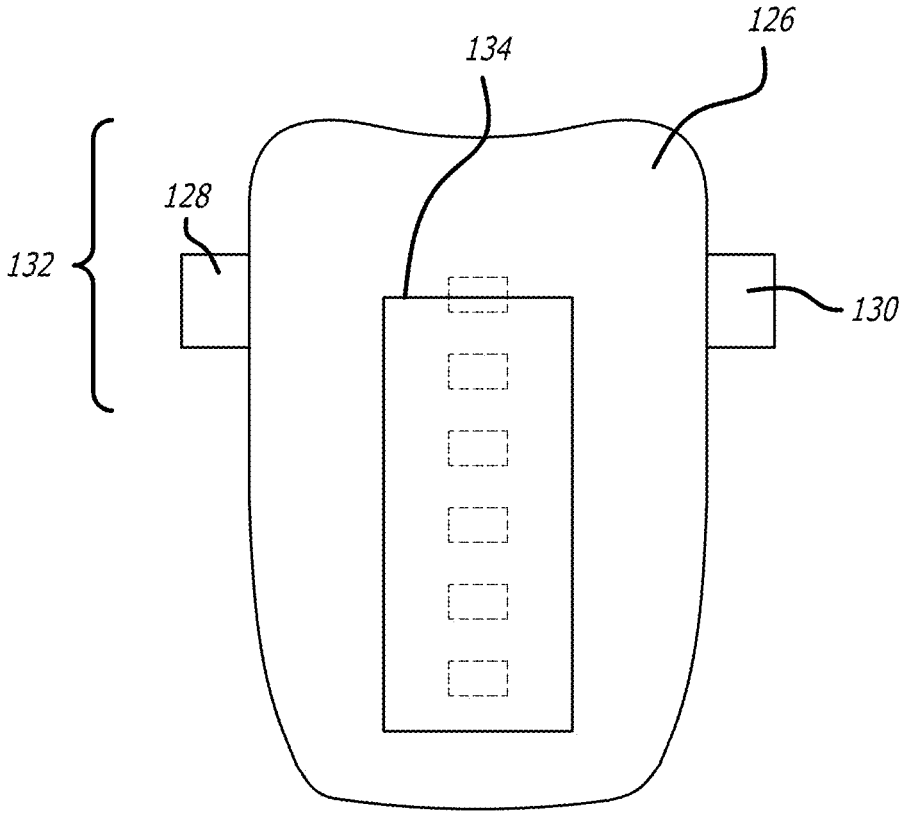
FIG. 14 is a bottom view of a tongue and an instep support.
Figure 15:
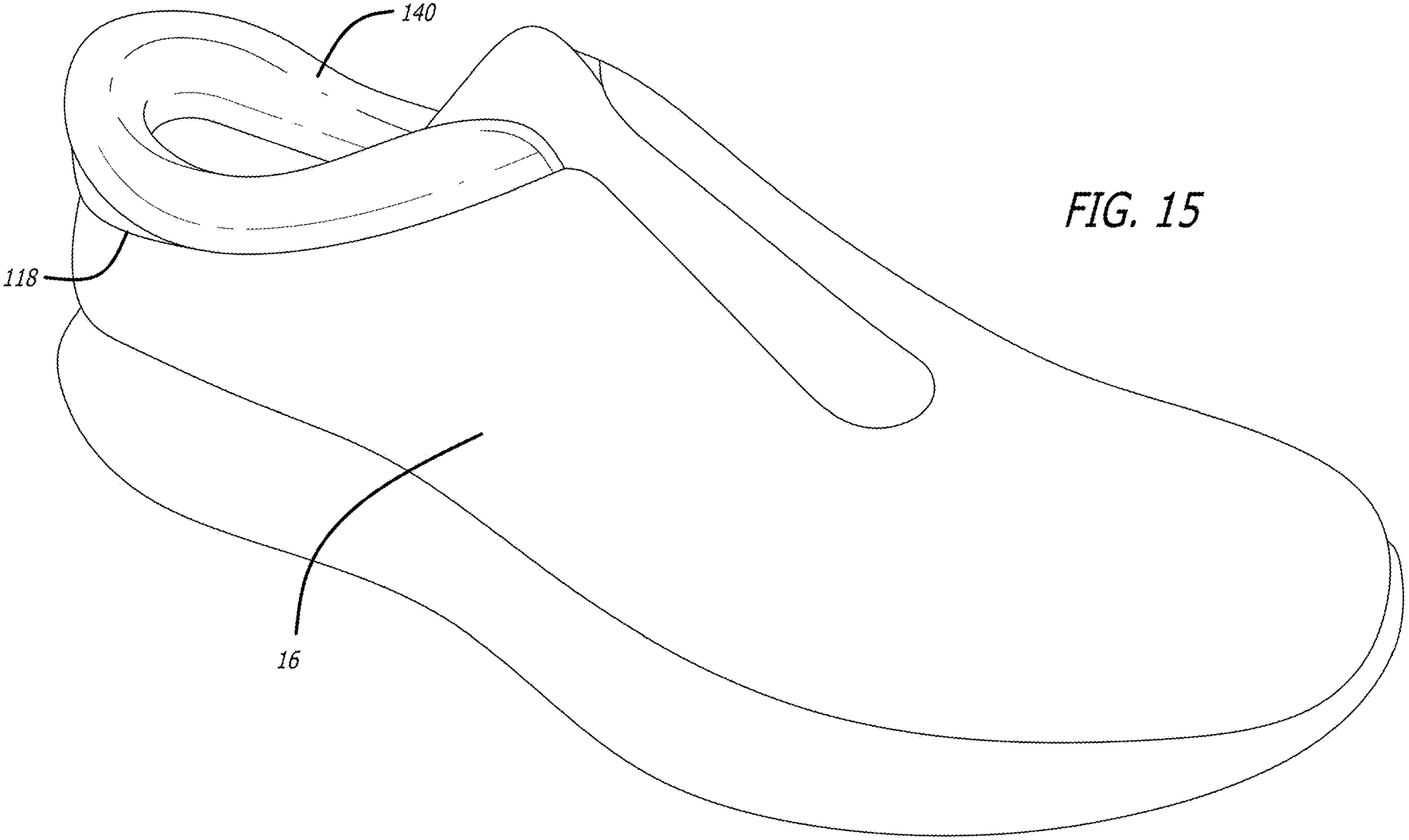
FIG. 15 is a perspective view of a shoe with a cushioned lining.
Figure 16:
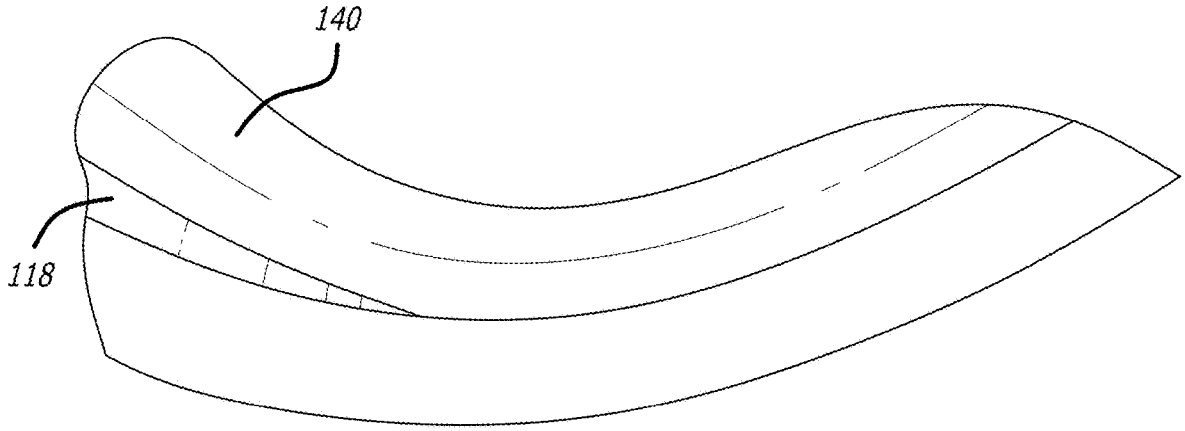
FIG. 16 is a side view of the cushioned lining of FIG. 15.

In some embodiments having a tongue 126 as shown in FIG. 14, the medial side of the upper portion 132 of the tongue 126 is attached to the first or proximal end of a medial elastic strap 128 and the lateral side of the upper portion 132 of the tongue 126 is attached to the first or proximal end of a lateral elastic strap 130. The front lower portion of the tongue is attached directly to the upper. Each of the medial and lateral elastic straps may be attached to the upper directly to the inner lining of the upper at its second or distal ends. In an alternate embodiment, the elastic straps may extend through an opening of the inner lining of the medial quarter and lateral quarter respectively. The second end of each of the medial and lateral elastic straps may terminate respectively at the sole, sockliner, or a region within the upper's interior lining. The elastic straps function to maintain the general positioning of the tongue when the user dons the shoe.

In other embodiments, each of the medial and lateral sides of the edge of the tongue or an upper portion of the tongue are attached by a gusset which may be of elastic material, to the inner lining of the upper of the medial quarter and lateral quarter of the upper. The gusset similarly may function to maintain the general positioning of the tongue when the user dons the shoe. In another embodiment of the tongue, the at least a portion of the medial and lateral edges of the tongue may be directly affixed or stitched to the interior portion of the upper and the tongue. Furthermore, the tongue may be extended wider than a conventional tongue along the mediolateral direction in the upper portion of the tongue and the edges or some portion of the extended portion may be affixed or stitched to the interior portion of the upper.

In other embodiments, an instep or tongue support which may be constructed of a sheet-like material of greater hardness than the fabric of the instep or tongue may be attached to the outer surface of the tongue or embedded between an exterior tongue layer and an inner tongue layer facing the shoe opening. The instep or tongue support may reduce or prevent the instep or tongue from collapsing during the insertion of the foot. In one embodiment shown in FIG. 14, tongue support 134 may be a more rigid material such as a thermoplastic polymer configured to be more rigid than the tongue. In some embodiments, the instep or tongue support may have a thickness of 0.2 mm to 1 mm. The instep support may be coextensive with the instep or tongue, or it may extend beyond the medial or lateral sides of the instep or tongue. In the embodiment shown in FIG. 14, the tongue support 134 may be narrower and shorter than the instep or tongue.

In one embodiment, a reinforcing quarter element may extend from the heel counter to the instep or eyestay. When a gusset is incorporated such as gusset 80 in FIG. 11-12, a reinforcing quarter element may extend from the heel counter 32 along the front lower edge of the gusset and around the top edge of the collar to the instep, a region near vamp 24, or an eyestay adjacent to a tongue. A reinforcing quarter element may be stiffer than the upper or quarter material. The reinforcing quarter element material may be constructed of leather, plastic, or rigid fabric. The reinforcing quarter element may be attached to the upper through bonding or stitching. The reinforcing quarter element may be configured as an elongated shape such as a strip that extends along the front lower edge of the gusset and the collar portion. The reinforcing quarter element may be located on the exterior surface or may be an interior layer of the upper such as a layer embedded within the upper or along a portion of the inner lining of the upper. A reinforcing quarter element may provide greater stability to the opening of the shoe such that it provides resistance against the quarters and instep region collapsing or moving inward into the opening of the shoe when the foot is inserted into the shoe and pushes the heel cup rearward.

When the reinforcing quarter element is used in combination with an eyestay layer used in laced shoes, the eyestay may add additional structural support in providing resistance against the quarters and instep from collapsing or moving inward into the opening of the shoe. Thus, as a foot pushes against the heel cup and the gusset is stretched rearward, the reinforcing quarter element is not significantly pulled rearward. Accordingly, the shoe opening may attain a wider opening when the foot is inserted into the shoe and pushes the heel cup rearward.

Compressible lining. In some embodiments, the inner surface of the heel counter and heel/ankle collar may have a portion having a compressible layer such as a foam layer. The compressible layer may extend into the shoe opening. The compressible layer is compressed under a load during the donning or removal of the shoe. After the foot is inserted into the shoe, the foam layer may expand fully or partially to its uncompressed state, and such expansion may enhance the securement of the foot within the shoe.

In one exemplary embodiment, the compressible layer 100 is embedded at least within a portion of the ankle collar 140 and the upper region of the heel counter 32. See FIGS. 15-19. The compressible layer 100 extends into the opening of the shoe. During the donning of the shoe, the foot exerts a load onto the compressible layer thereby widening the opening of the shoe through the transient compression of the compressible layer. After the foot is inserted into the shoe, the compressible layer expands partially or fully back to its original shape. Expansion of the compressible layer causes the foam to expand around the foot which may enhance comfort and securement of the foot. In some embodiments, the compressible layer extends above and/or around the calcaneus bone of the user's foot and around at least portions of the ankle region of the foot.

Figure 17:
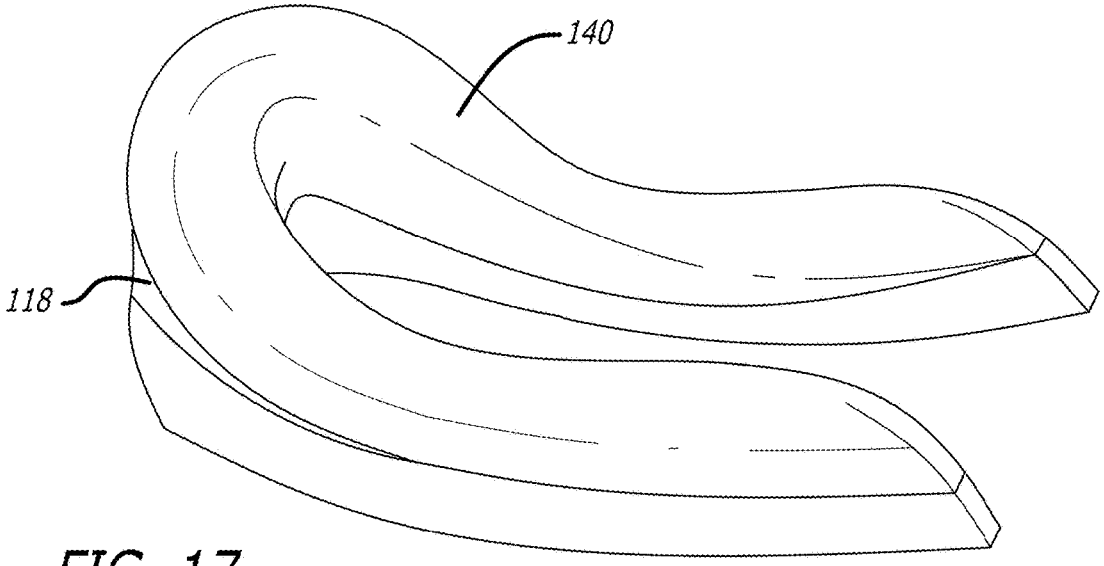
FIG. 17 is a perspective view of the cushioned lining of FIG. 15.
Figure 18:
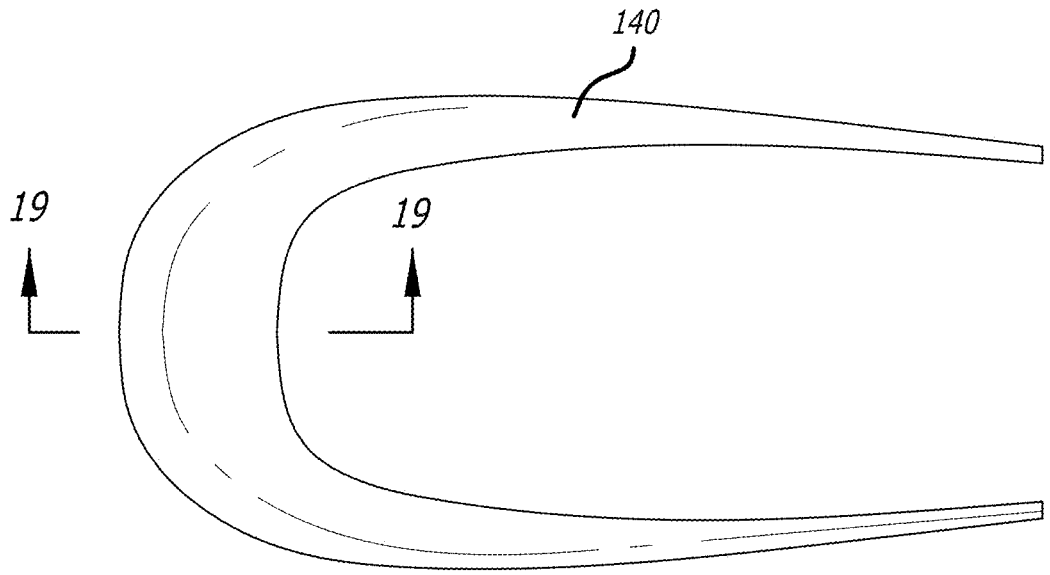
FIG. 18 is a top view of the cushioned lining of FIG. 15.
Figure 19:
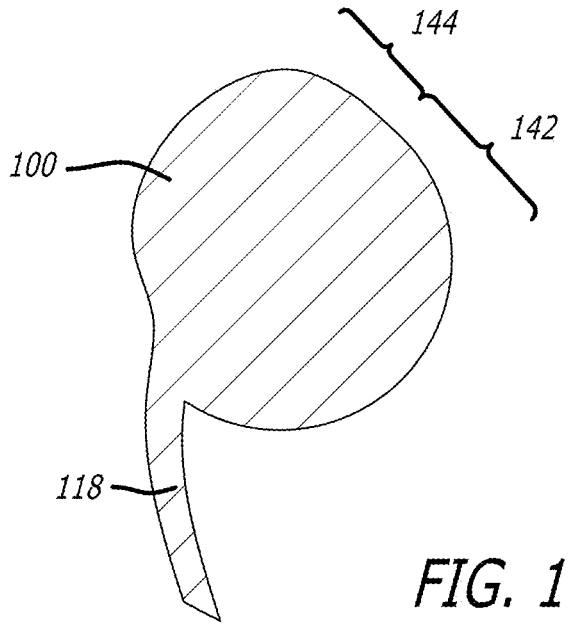
FIG. 19 is a cross-sectional view of the cushioned lining of FIG. 18 taken at lines 19-19.

The compressible layer may be constructed of a material of a foam material such as EVA or polyurethane foam. The shape of the compressible layer may be pre-formed by molding the material, and affixing the compressible layer between at least two layers of textile material. The shape of the compressible layer may have at least partially a rounded outer surface that extends into the opening of the shoe and/or the ankle collar of the shoe. The volume of the compressible layer may be greater in the rear portion of the heel counter and taper along longitudinal direction of the inner portion of the foam layer at both sides of the shoe as shown in FIGS. 17-18. The compressible layer may also taper or be rounded along the vertical axis and that the compressible layer is greater in volume at the upper portion of the ankle collar 140 and less at the lower portion of the ankle collar 140. See FIGS. 18-19. The compressible layer may be used to form the entire heel cup without the need of an additional heel cup or heel counter. Alternatively, the compressible layer can be used in combination with a compressible heel cup, such as shown in FIG. 1. The heel cup can define an exterior surface of the upper, the heel cup can define an interior surface of the upper, or the heel cup can define an internal layer, for example, if embedded within the compressible layer.

In the exemplary embodiment, a lower flange 118 may extend downward from the ankle collar and is configured to attach to the upper. The lower flange may be configured in any dimensions necessary to secure the ankle collar to the upper. The lower flange may also vary in the length. In some embodiments, the lower flange may define the portion of the ankle collar attached to the upper without extending downward from the ankle collar at all. In other embodiments, the lower flange may extend downward partially or fully to the bottom of the upper. In some embodiments, the lower flange may be configured to form the heel counter. In other embodiments, a heel cup, such as shown in FIG. 1, may be partially or fully embedded in lower flange.

The compressible layer 100 may be covered by any type of textile. The textile may be elastic and may have wicking properties. The textile may be form fitted to the exterior shape of the compressible layer. In a preferred embodiment, an adhesive such as a thermoplastic based adhesive is applied to the compressible layer after which the compressible layer is inserted into an elastic textile sleeve. The resulting product may also be affixed by any means such as glue or stitching according to the desired pattern of the ankle collar 140. The textile may also include thermoplastic material and after the compressible layer 100 is inserted into the textile sleeve, heat may be applied to fuse the textile to the compressible layer 100. In a preferred embodiment, steam may be applied so that the textile conforms to the preformed shape that forms a portion of the ankle collar and/or heel counter.

Further to the exemplary embodiment, the ankle collar 140 is devoid of stitches or seams on its upper portion and may have a seam on the bottom portion where it is attached to the upper 16. The seamless ankle collar 140 may extend from the medial quarter, around the heel, to the lateral quarter. As the user's foot is inserted into the footwear, the user's heel depresses the compressible layer 100 against the heel cup. The heel cup may keep the structural integrity of a portion of the heel region of the upper 16 from collapsing when the user's heel depresses the compressible layer 100, thus allowing for an easier entry into the shoe by the user's foot without the use the user's hands or an external shoehorn. Once the user's heel is fully inserted into the shoe, the compressible layer may rebound and may exert force against the back of the user's heel above the calcaneus bone and around portions of the ankle region which may aid in providing comfort and securing the user's foot within the shoe.

Further to the exemplary embodiment, the cross-section of the seamless upper portion of the ankle collar 140 is substantially round. The ankle collar 140 may be separated into a forward portion 142 and a rear portion 144. Each of the forward portion and rear portion resemble an approximately circular cross-section or semicircular cross-section wherein the radius of the forward portion is greater than the radius of the rear portion. See FIGS. 18-19. The compressible layer may be directly attached to the inner structure of the heel counter or via the textile sleeve covering the compressible layer material.

Figure 20A:
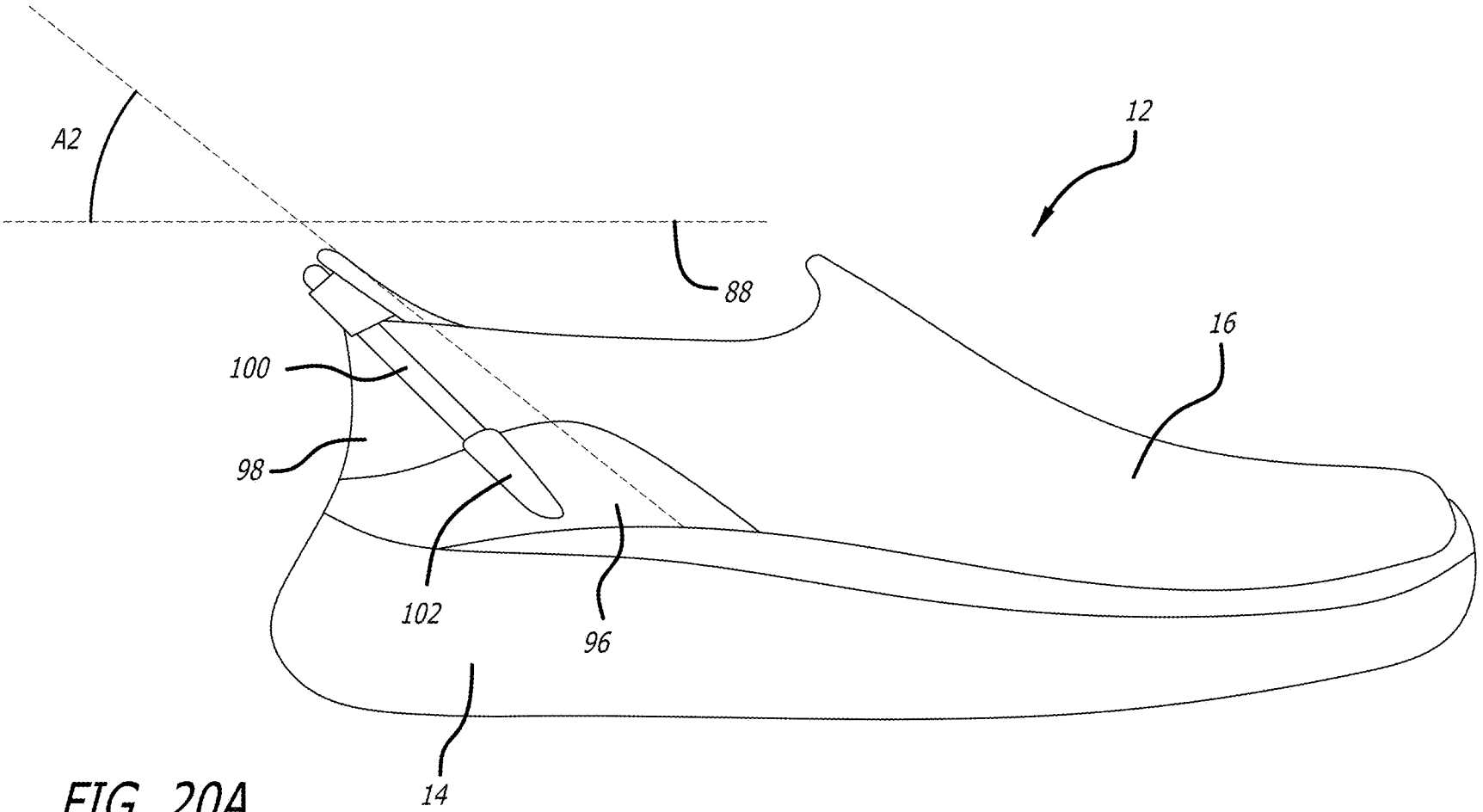
FIG. 20A is a lateral view of a shoe with a heel counter support.
Figure 20B:
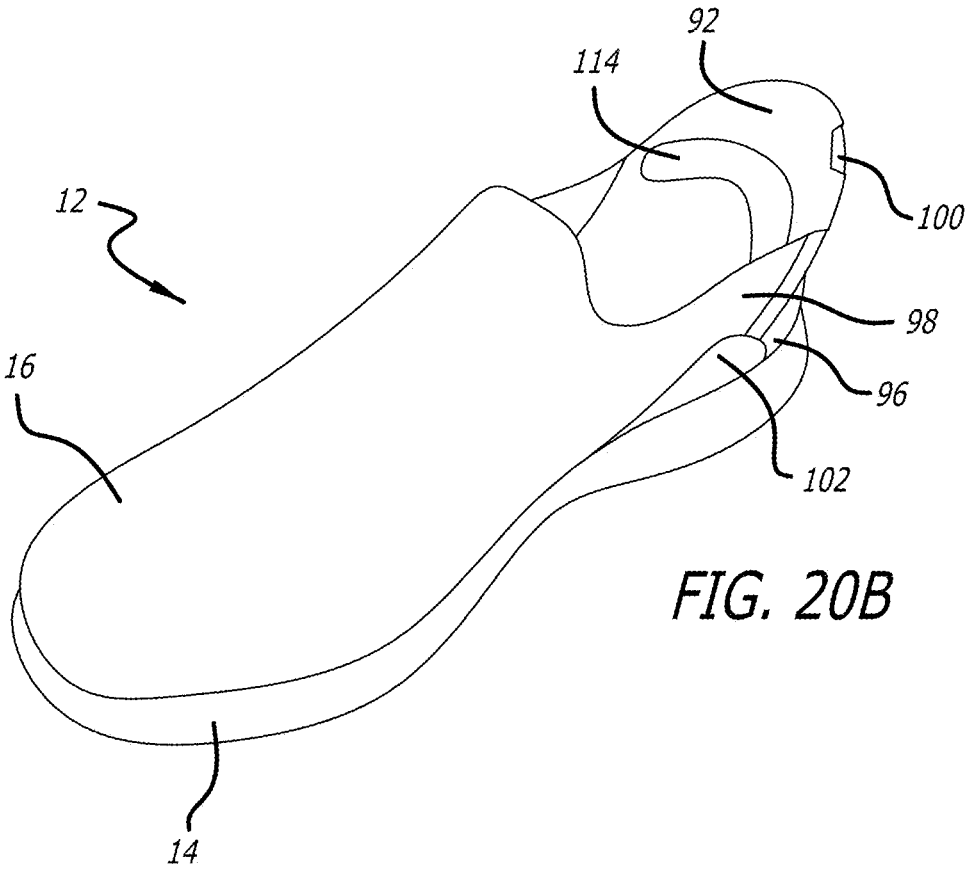
FIG. 20B is a perspective view of a shoe with a heel counter support.
Figure 20C:
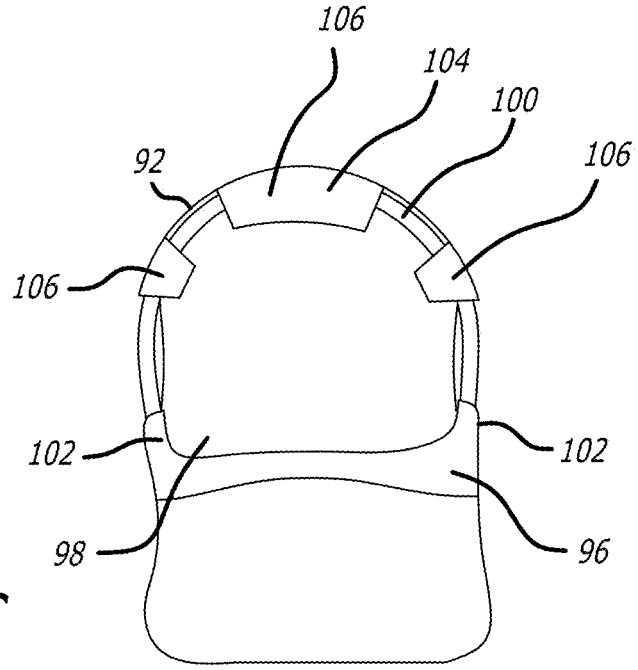
FIG. 20C is a rear view of the shoe of FIG. 20A.
Figure 21:
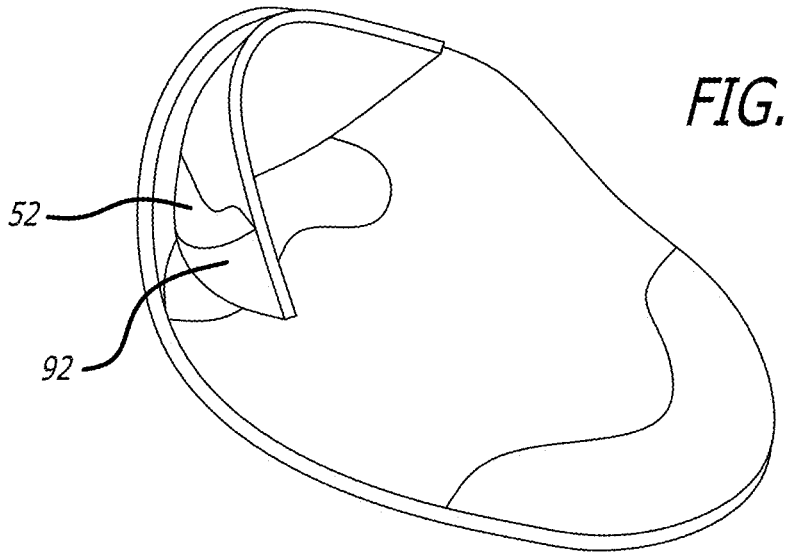
FIG. 21 is a perspective view of the bottom of the upper of the shoe of FIGS. 20A-20C.
Figure 22:
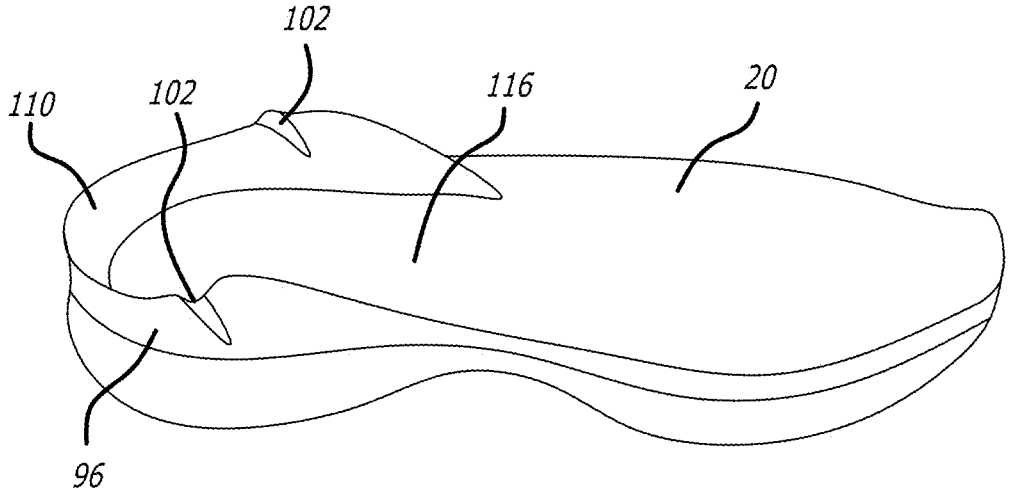
FIG. 22 is a perspective view of the sole and heel counter support of the shoe of FIGS. 20A-20C.

Compressible Heel Counter with Heel Counter Support. In another exemplary embodiment, heel counter support 96 may partially form an exterior layer of the shoe and extend around the heel portion of the upper 16 from the medial quarter of the shoe to the lateral quarter of the shoe as shown in FIGS. 20-22. In other embodiments, the heel counter support may further extend along a portion of the quarter, along the entire quarter, or along the entire quarter and into the vamp portion of the shoe. The heel counter support 96 may vary in height at different regions of the shoe. In the exemplary embodiment, the medial end and lateral end of the heel counter support 96 gradually decreases in height to the base of the upper 16 just above the sole 14. The heel counter support 96 may have a medial region of a maximum height on the medial side of the heel portion of the upper, and a maximum height on the lateral side on the heel portion of the upper. The heel counter support 96 extends at least a portion of the height of the upper 16. In the exemplary embodiment, the height of the medial and lateral side heel portions 98 of the upper 16 is roughly 5 cm above the lasting surface 116 and the maximum height of the heel counter support 96 on the medial and lateral sides of the heel portion is roughly 3 centimeters above the lasting surface 116. The heel counter support 96 may gradually reduce in height from the region of its maximum height to a region of roughly uniform height along the rear of the heel portion 98 of the upper 16. In the exemplary embodiment, the height along the heel portion 98 of the upper 16 extents up to roughly 3 centimeters above the lasting surface 116, and the roughly uniform height of the portion forming rear portion of the heel counter support 96 is roughly 2 centimeters above the lasting surface 116.

The heel counter support 96 may partially form an exterior surface of the upper 16. The heel counter support 96 may have an interior surface in contact with an outer surface of the heel portion 98 of the upper 16. The heel counter support 96 may have a varying thickness across its exterior surface to its interior surface. In the exemplary embodiment, angular strips 102 form portions of increased thickness of the heel counter support 96. The angular strips 102 may provide increased rigidity to the heel counter support 96 as well as be configured to receive the compressible component 100.

In the exemplary embodiments, the angular strips 102 have hollowed protrusions on the medial and lateral sides of the shoe 12 into which the ends of the compressible component 100 are secured. The compressible component 100 may be a pipe wherein each end of the pipe is secured within the hollowed protrusions 102. A hollowed protrusion of the angular strips 102 may extend partially or completely around the surfaces of the compressible component 100. In the exemplary embodiment, the compressible component 100 may be formed from polyoxymethylene or any other material with similar durability and sufficient rigidity to support the load of a foot and flexibility to curve from medial to lateral sides of the heel portion of the shoe 12. The central segment 104 of the compressible component 100 may extend behind the ankle opening and above the heel counter of the shoe 12. In the exemplary embodiment, the angular strips 102 may be designed to receive the compressible component 100 at an angle so that the compressible component 100 extends from inside the hollowed protrusions 102 at a rearward incline A2 toward the back of the shoe 12. The rearward incline A2 of the compressible component 100 is approximately 45 degrees with respect to a level plane of the floor 88. See FIG. 20A. A foam layer 92 extending above the rear heel portion 98 of the upper 16 at the rear portion of the heel opening may have a rearward incline A2 that is coextensive with the compressible component 100. The rearward incline A2 of the foam layer 92 may assist in guiding the user's foot into the shoe 12 when donning the shoe.

The central segment 104 of the compressible component 100 may extend behind the rearmost portion of the upper 16 and may be threaded through one or more guide tunnels 106 in the upper 16. In the exemplary embodiment, strips of leather material are sewed to the foam layer 92 and extend above the upper at the rear portion of the heel opening. The ends of the strip of leather are stitched together to form guide tunnels 106 through which the compressible component is threaded.

When donning the shoe 12, the user's foot may depress the compressible component 100 and/or the rearwardly inclined foam layer 92 downward and rearward from the shoe opening. Once the user's foot has fully entered the shoe 12, the compressible component 100 and the rearwardly inclined foam layer 92 return to their initial elevated positions.

The additional interior heel support 114 made of foam material may have sufficient thickness that may enhance securing the foot at the Achilles tendon, and once the user dons the shoe 12, the calcaneus bone may be located below the additional interior heel support 114. The interior heel support 114 may have a sufficient height to be located above the calcaneus bone once the foot has been inserted into the shoe.

Further to the exemplary embodiment, the shoe may have a heel cup 52 made of a flexible material configured to receive the rear portion of the heel. In one embodiment, the heel cup is a thermoplastic material that provides sufficient support as a heel counter. The interior heel support 114 may be foam material lining to provide the necessary comfort to the user's heel.

Although the present invention has been described above by referring to particular embodiments, it should be understood that modifications and variations could be made to the sole structure without departing from the intended scope of invention.

We claim:

1. A shoe comprising:

an upper and sole structure, the upper defining a foot receiving shoe opening;

a heel counter comprising a heel cup attached to the upper and extending from the sole structure to at least a portion of the rear heel collar of upper, the heel cup with a rearmost portion having an overall vertical S wave cross-sectional shape, wherein the heel cup is uniformly molded with an upper portion, midportion, and lower portion, the upper portion having a smaller mediolateral length than the midportion;

a heel region of the upper having a rearward facing upper concavity and a forward facing lower concavity, the upper concavity having a first depth, the lower concavity having a second depth, the second depth being greater than the first depth;

an interior compressible foam layer attached to the heel cup, wherein the foam layer protrudes into a shoe opening, the foam layer configured to compress under a load during the donning or removal of the shoe, and wherein the interior compressible foam layer is configured, after the foot is inserted into the shoe, to expand fully or partially to its uncompressed state.

2. The shoe of claim 1, further comprising:

at least two layers of textile material, wherein the interior compressible foam layer is affixed between the at least two layers of textile material.

3. The shoe of claim 1, wherein an upper amplitude of the upper concavity is approximately ⅓ of a lower amplitude of the lower concavity.

4. The shoe of claim 3, wherein the upper amplitude of the upper concavity is approximately 3 millimeters, and a lower amplitude of the lower concavity is approximately 9 millimeters.

5. The shoe of claim 1, wherein an upper portion arc width of the vertical S wave cross-sectional shape is approximately 0.44 times a lower portion arc width of the vertical S wave cross-sectional shape.

6. The shoe of claim 1, wherein an upper portion arc width of the vertical S wave cross-sectional shape is approximately 2 centimeters, and a lower portion arc width of the vertical S wave cross-sectional shape is approximately 4.5 centimeters.

7. The shoe of claim 1, the upper portion having a first configuration;

the upper portion capable of distorting into a second configuration under a load of a user's foot;

the upper portion capable of returning to the first configuration after the load of the user's foot is removed; and wherein the upper portion in the first configuration has a downward incline with a first angle relative to a vertical line that is normal to a horizontal surface of the floor;

the upper portion in the second configuration has an incline with a second angle; and the second angle is greater than the first angle; and a lower region of a central portion extends outwardly in the second configuration in a direction that causes the shoe opening to widen along the mediolateral direction.

8. The shoe of claim 1, wherein the shoe opening is configured to widen along the mediolateral direction by approximately 50%.

9. The shoe of claim 1, wherein the heel cup is constructed of a rigid material that does not substantially compress under the load of the user's foot.

10. The shoe of claim 1, wherein the interior compressible foam layer is at least adjacent to the upper portion and midportion of the heel cup.

11. The shoe of claim 10, wherein the compressible foam layer is thicker than the lower portion.

12. The shoe of claim 1, wherein the interior compressible foam layer that is at least adjacent to the upper portion and midportion of the heel cup is thicker than other areas of the interior compressible foam layer.

13. The shoe of claim 1, wherein the interior compressible foam layer is configured, after the foot is inserted into the shoe, to be located above the calcaneus bone region of the foot and extend around at least portions of the ankle region of the foot.

14. The shoe of claim 1, wherein the interior compressible foam layer is rearwardly inclined.

15. The shoe of claim 1, wherein, in a vertical cross-section, the upper portion has a first thickness in a first location, the midportion has a second thickness in a second location, and the lower portion has a third thickness in a third location;

wherein the second thickness is smaller than at least one of the first thickness and the third thickness.

16. The shoe of claim 15, wherein the second thickness is smaller than both of the first thickness and the third thickness.

17. The shoe of claim 1, wherein the interior compressible foam layer may extend at least a portion along the mediolateral length and configured to curve around at least a portion of the ankle above the heel.

18. The shoe of claim 1, wherein the interior compressible foam layer has a uniform thickness.

19. A shoe comprising:

an upper and sole structure, the upper defining a foot receiving shoe opening;

a heel counter comprising a heel cup attached to the upper and extending from the sole structure to at least a portion of the rear heel collar of upper, the heel cup with a rearmost portion having an overall vertical S wave cross-sectional shape, wherein the heel cup is uniformly molded with an upper portion, midportion, and lower portion, the upper portion having a smaller mediolateral length than the midportion;

a heel region of the upper having a rearward facing upper concavity and a forward facing lower concavity, the upper concavity having a first depth, the lower concavity having a second depth, the second depth being greater than the first depth;

wherein an upper amplitude of the upper concavity is approximately 3 millimeters, and a lower amplitude of the lower concavity is approximately 9 millimeters;

an interior compressible foam layer attached to the heel cup, wherein the foam layer protrudes into a shoe opening, the foam layer configured to compress under a load during the donning or removal of the shoe, and wherein the interior compressible foam layer is configured, after the foot is inserted into the shoe, to expand fully or partially to its uncompressed state.

* * * * *